United States Patent [19]

Fournier et al.

[11] 4,312,154

[45] Jan. 26, 1982

[54] GRINDING MACHINE AND METHOD

[75] Inventors: Roger H. Fournier, Millbury; Richard P. Chase, Spencer; Gary E. Englander, Shrewsbury, all of Mass.

[73] Assignee: The Warner & Swasey Company, Cleveland, Ohio

[21] Appl. No.: 82,039

[22] Filed: Oct. 5, 1979

[51] Int. Cl.[3] ..... B24B 5/36

[52] U.S. Cl. ..... 51/101 R; 51/165.71; 51/281 C

[58] Field of Search ..... 51/101 R, 165.71, 281 C

[56] References Cited

U.S. PATENT DOCUMENTS

| | | | |
|---|---|---|---|
| 2,535,130 | 12/1950 | Green . | |
| 2,786,311 | 3/1957 | Hill . | |
| 2,813,378 | 11/1957 | Hill | 51/101 R |
| 4,005,551 | 2/1977 | Lines | 51/101 R |
| 4,115,958 | 9/1978 | Englander | 51/165.71 |

FOREIGN PATENT DOCUMENTS 1094097 12/1967 United Kingdom .

OTHER PUBLICATIONS

A treatise on Cam and Shape Grinding, Norton Co. 1961.

*Primary Examiner*—Harold D. Whitehead
*Attorney, Agent, or Firm*—Yount & Tarolli

[57] ABSTRACT

An improved method and grinding machine are used to grind lobes on a camshaft. The grinding machine includes a longitudinally extending rocker bar which is pivotally mounted on a work table or carriage. A headstock and tailstock are connected with the rocker bar to rotatably support the camshaft as the cam lobes are ground by a grinding wheel. A control assembly includes a motor which is operated to pivot the rocker bar from a retracted or loading position through an index position to an operating position in a range of operating positions. Immediately before the rocker bar reaches the range of operating positions, the speed of the motor is reduced to effect a corresponding reduction in the speed of movement of the rocker bar. In addition, the motor actuates a biasing assembly to urge the rocker bar toward the camshaft with a relatively large force during a rough grinding operation and a reduced force during a finish grinding operation. During the rough and finish grinding operations, a master cam assembly and follower cooperate to move the rocker bar in the range of operating positions as a function of the desired cam lobe configuration. The cam follower is movable into alignment with a selected one of a plurality of cam elements in the master cam assembly by a motor which is mounted on the carriage. A stop member is utilized to stop the rocker bar when it has moved away from the grinding wheel to the index position. This enables the cam follower to be aligned with a selected master cam element between the grinding of successive lobes on the camshaft without moving the rocker bar all the way back to the loading position. When the grinding of the camshaft is completed, the stop member is retracted to enable the rocker bar to be pivoted to the loading position.

54 Claims, 23 Drawing Figures

GRINDING MACHINE AND METHOD

BACKGROUND OF THE INVENTION

This invention relates to a method and apparatus for grinding camshafts.

Specialized grinding machines and methods have previously been used to grind the lobes on engine camshafts. The use of these specialized machines is necessary due to the irregular configuration and angular orientation of the cam lobes. The irregular cam lobe configuration makes it necessary to move the camshaft toward and away from a grinding wheel as the camshaft is being rotated with the grinding wheel in engagement with a lobe on the camshaft. In order to provide for this movement of the camshaft, the headstock and tailstock which rotate the camshaft have been mounted on a rocker bar which is pivoted toward and away from the grinding wheel by a cam follower and master cam assembly. Biasing springs have been utilized to urge the rocker bar toward the grinding wheel and to maintain the cam follower and master cam assembly in engagement during a grinding operation.

Since the movement of the rocker bar toward and away from the grinding wheel will vary with the configuration of the particular cam lobe which is being ground, the master cam assembly commonly includes a plurality of cam elements with at least one cam element for each lobe on the camshaft. Upon completion of the grinding of a cam lobe, the work table or carriage is moved relative to the grinding wheel to move the next succeeding cam lobe into alignment with the grinding wheel. This indexing operation has been performed with the rocker bar in a fully retracted or loading position in which the cam lobes are spaced from the grinding wheel and in which the master cam assembly is spaced as far as possible from the cam follower. As the next succeeding cam lobe is moved into alignment with the grinding wheel, a dog on the base of the grinding machine actuates a star wheel to move the cam follower into alignment with the master cam which is associated with the next lobe on the camshaft. Typical of these known grinding machines are the grinding machines disclosed in U.S. Pat. Nos. 2,535,130 and 2,786,311.

These known grinding machines have been very satisfactory in their general mode of operation. However, it is desirable to increase the accuracy, ease of manufacture and use, and the operating speed of these known camshaft grinding machines.

The accuracy with which a known camshaft grinding machine is effective to grind the lobes on a camshaft is, in part, determined by the accuracy with which the master cam assembly and cam follower move the rocker bar toward and away from the grinding wheel. During a rough grinding operation, marterial is removed at a relatively high rate from the lobe on the camshaft. This high rate of material removal results in relatively large operating forces being present between the grinding wheel and camshaft. In order to overcome these relatively large operating forces, large biasing forces have been utilized to urge the rocker bar toward the grinding wheel. These relatively large rocker bar biasing forces also press the master cam assembly and cam follower into abutting engagement.

Due to the relatively large magnitude of the rocker bar biasing forces required for a rough grinding operation, the forces pressing the master cam assembly against the cam follower can result in deflection of components of the grinding machine in such a manner as to introduce inaccuracies in the grinding of the cam lobes. These inaccuracies are relatively small and are not excessively troublesome during rough grinding of a cam lobe. However, during finish grinding of a cam lobe, even the slight inaccuracies introduced by the large rocker bar biasing forces are objectionable.

With known camshaft grinding machines in which the cam follower is indexed relative to the master cams by engagement of a star wheel with dogs mounted on the base of the grinding machine, the cam follower must engage the master cam elements in a sequence which is the same as the sequence of the corresponding lobes on the camshaft. In addition, the dogs must be accurately adjusted to provide the desired indexing movement of the cam follower relative to the master cam assembly. It is possible for the known star wheel drive arrangement to malfunction so that the cam follower is not indexed by one of the dogs. Of course, this results in the cam follower being misaligned relative to the master cam assembly so that the cam lobes are not ground to the desired configuration.

During use of these known grinding machines, the rocker bar is moved from a loading position to a range of operating positions by a motor which is connected with the rocker bar. Each time the grinding of a lobe on a camshaft has been completed, the rocker bar is pivoted through a relatively large distance from the range of operating positions back to the loading position. Before the next cam is ground, the rocker bar must be pivoted back to an operating position. If the rocker bar motor is operated at a relatively high speed to pivot the rocker bar from the loading position to an operating position, objectionable impact forces may be present between the master cam assembly and cam follower.

SUMMARY OF THE PRESENT INVENTION

The present invention provides a camshaft grinding machine and method which improves the accuracy with which cam lobes can be ground, facilitates the setting up of the grinding machine to grind different camshafts, and increases the speed with which camshafts can be ground. In order to increase the accuracy with which cam lobes can be ground, the biasing force with which a camshaft is urged toward the grinding wheel is reduced during a finish grinding operation. By reducing the biasing force urging the camshaft toward the grinding wheel, the force on a master cam assembly is reduced with a resulting reduction in the deflection of the various components of the grinding machine. In addition, inaccuracies due to wear of the master cam assembly and/or follower are reduced by reducing the speed at which the master cam assembly and follower are moved into abutting engagement without unduly slowing the operating speed of the grinding machine.

In order to facilitate setting up and operating the grinding machine, the necessity of providing dogs to actuate a drive mechanism which moves a follower relative to a master cam assembly has been eliminated. In a grinding machine constructed in accordance with a feature of the present invention, the cam follower is moved independently of movement of a carriage or work table relative to a base of the machine. This is accomplished by providing a separate motor which is disposed on the carriage adjacent to the cam follower. A signal generator is associated with the cam follower motor to provide an output signal which can be utilized to determine the position of the cam follower relative to the master cam assembly.

In accordance with still another feature of the present invention, the speed of operation of the grinding machine is increased by reducing the extent of movement of the rocker bar between cam lobe grinding operations. Thus, when a first cam lobe has been ground, the rocker bar is moved from an operating position to an index position which is closer to the operating position than is the loading position. However, the distance which the rocker bar moves from the operating position to the index position is sufficient to separate the master cam assembly and cam follower so that the cam follower can be freely moved relative to the master cam assembly.

Accordingly, it is an object of this invention to provide a new and improved method and apparatus for grinding a camshaft and wherein the camshaft is urged toward a grinding wheel by a smaller force during a finish grinding operation than during a rough grinding operation to thereby reduce the operating loads to which components of the grinding machine are subjected during the finish grinding operation.

Another object of this invention is to provide a new and improved method and apparatus for grinding a camshaft and wherein a cam follower is moved relative to a master cam independently of movement of a carriage or work table relative to a base of the machine.

Another object of this invention is to provide a new and improved method and apparatus for grinding a camshaft and wherein after a cam lobe has been ground and prior to grinding of a succeeding cam lobe, the camshaft is moved to an index position which is between a range of operating positions and a fully retracted or loading position.

Another object of this invention is to provide a new and improved method and apparatus for grinding a camshaft and wherein the speed of relative movement between a master cam assembly and cam follower is reduced shortly before they are moved into abutting engagement to thereby reduce the operating forces to which components of the grinding machine are subjected.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Grinding Machine—General

Figure 1:
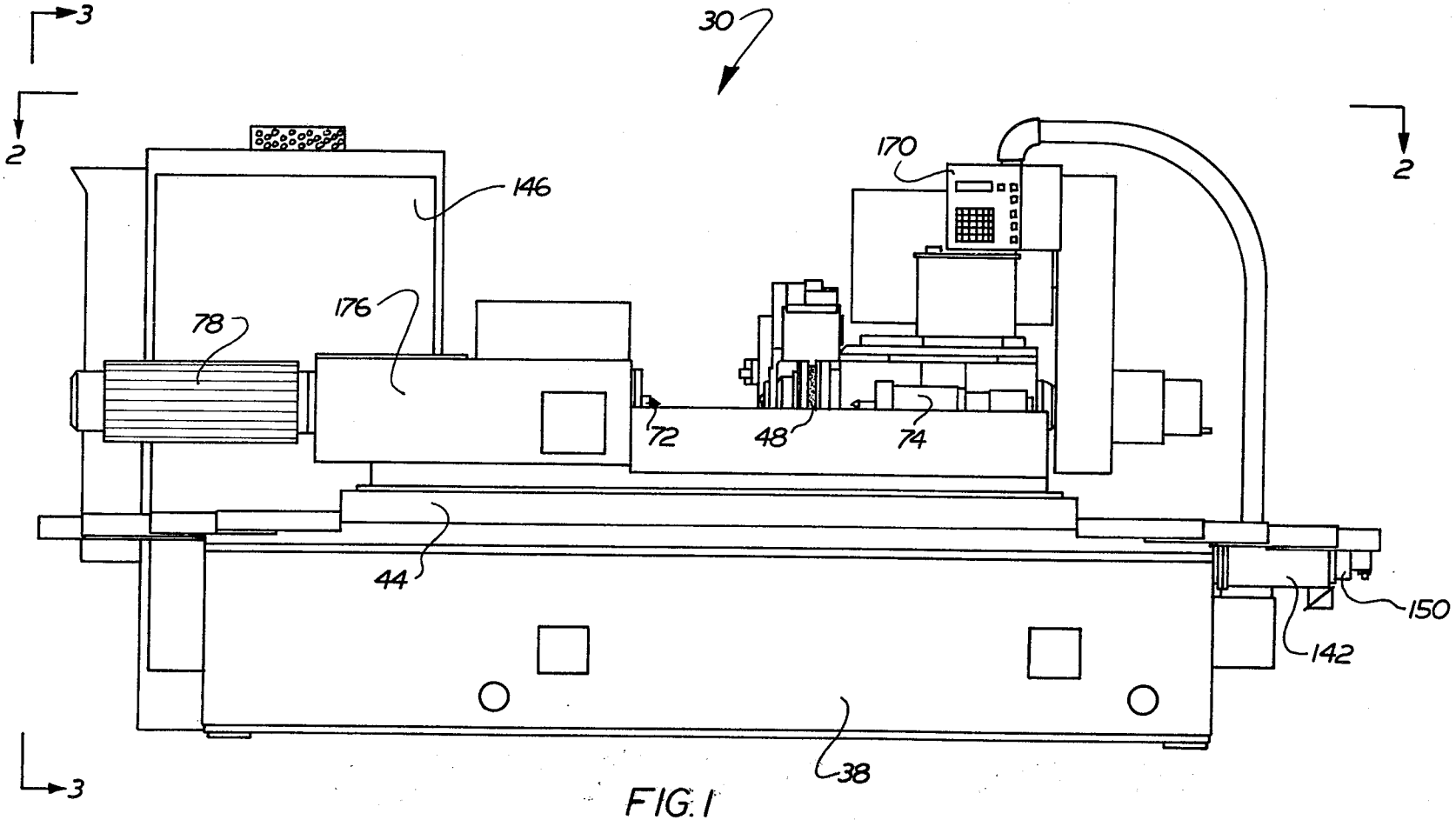
FIG. 1 is a front elevational view of a grinding machine constructed in accordance with the present invention.
Figure 2:
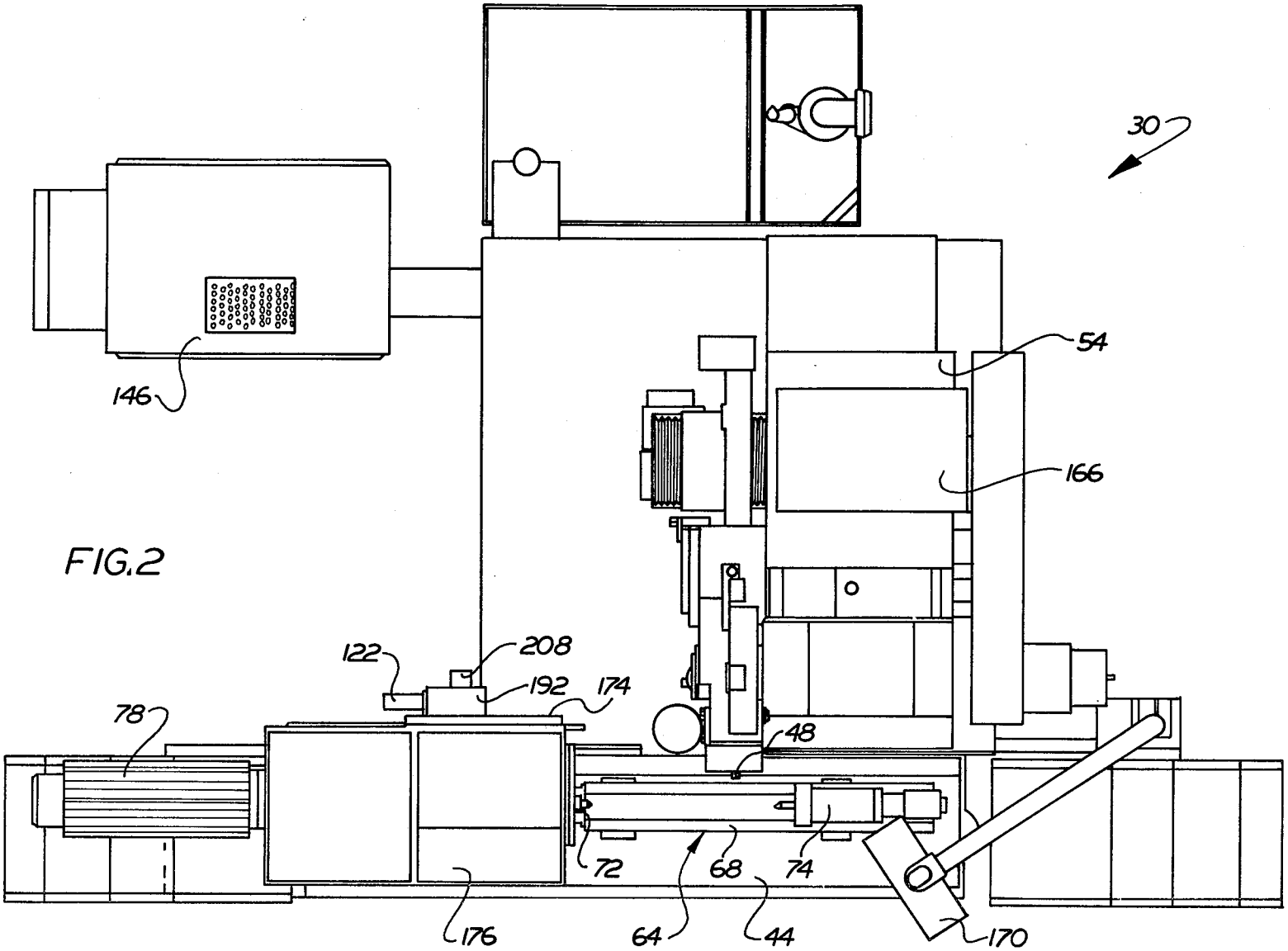
FIG. 2 is a plan view, taken generally along the line 2—2 of FIG. 1, further illustrating the construction of the grinding machine.
Figure 3:
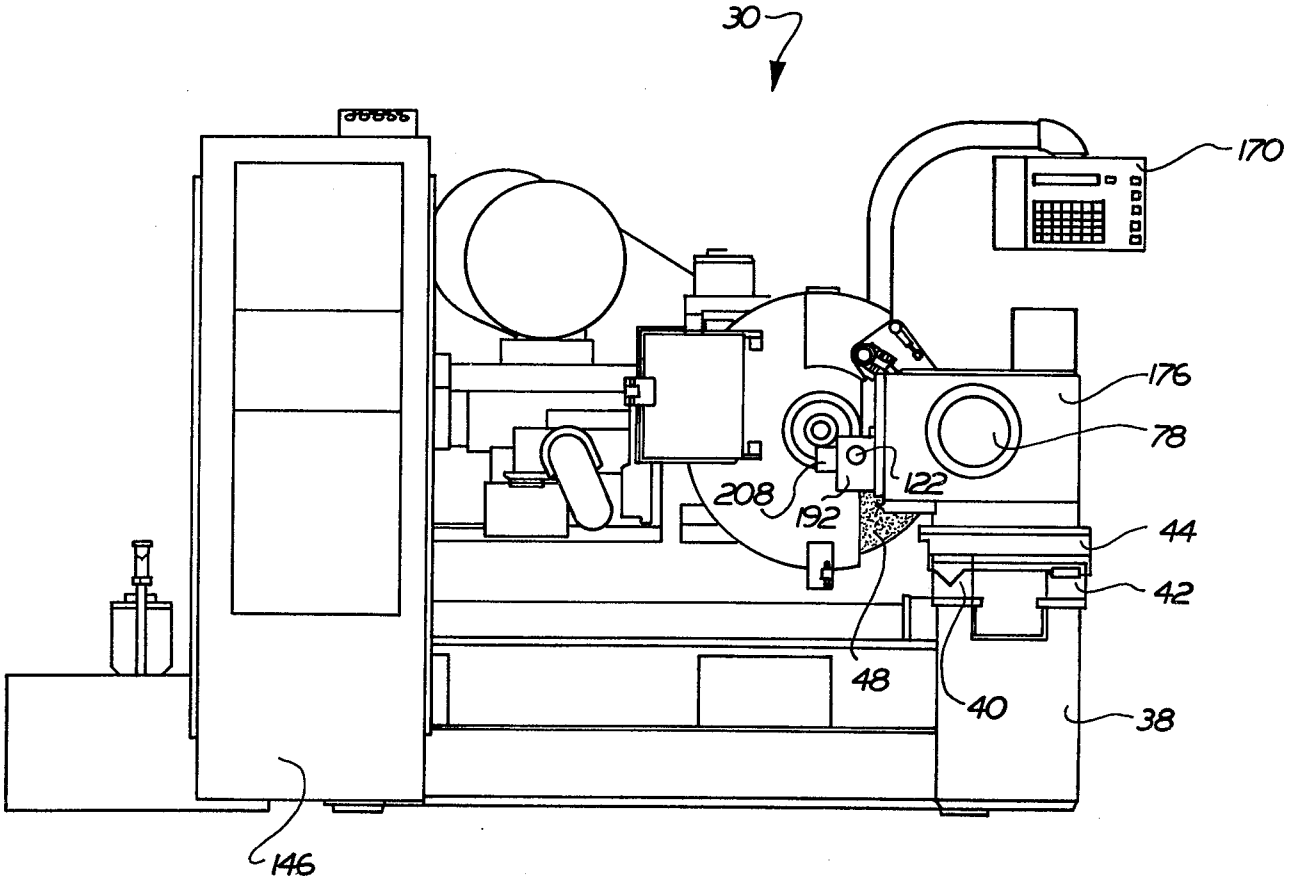
FIG. 3 is an end view, taken generally along the line 3—3 of FIG. 1, further illustrating the construction of the grinding machine.
Figure 4:
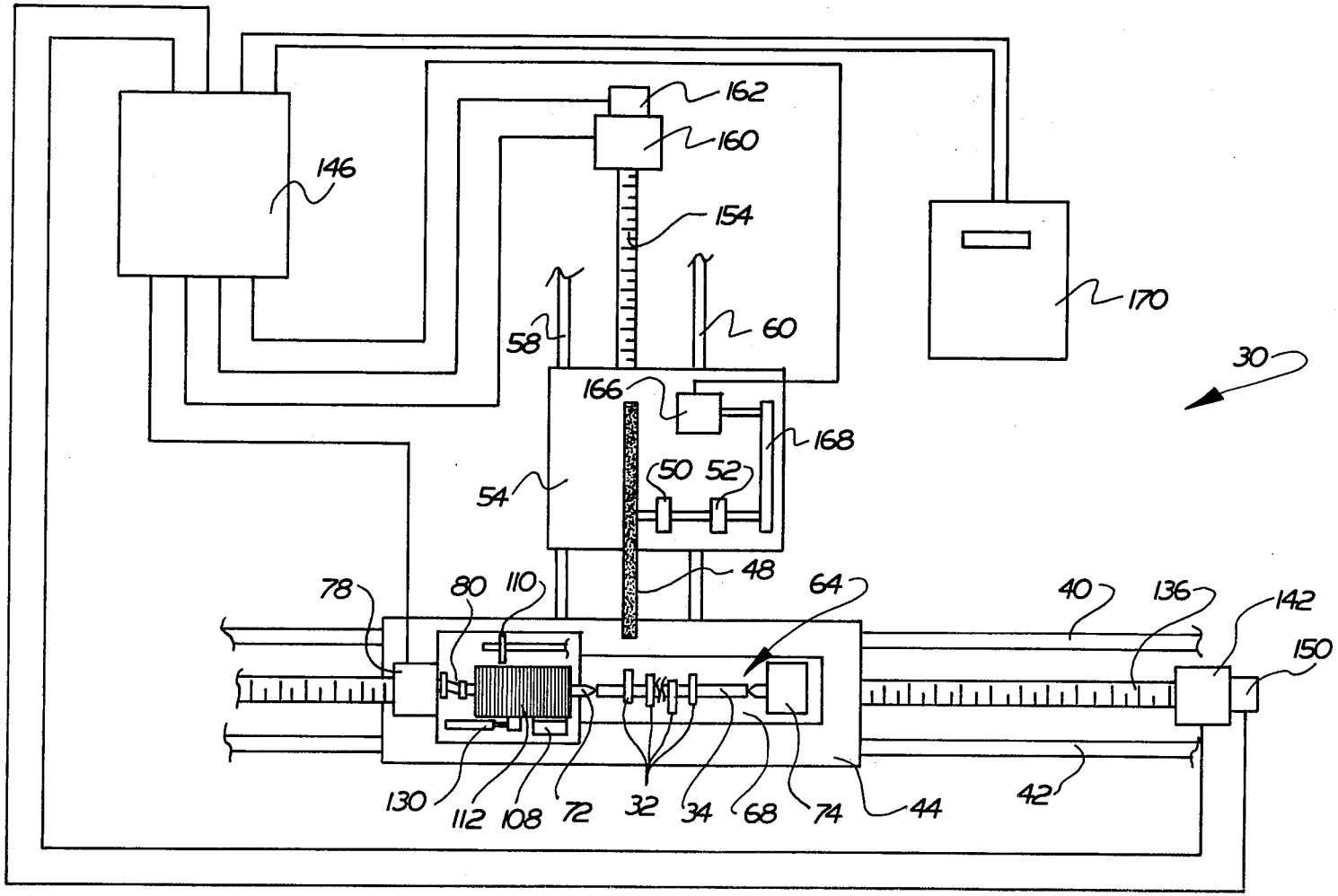
FIG. 4 is a schematic illustration of the grinding machine of FIG. 1 and illustrating the relationship between a control assembly, a motor for moving a grinding wheel toward and away from a work table upon which a camshaft is rotatably mounted, a motor for rotating the grinding wheel, a motor for rotating the camshaft, and a motor for moving the work table relative to the grinding wheel.

A grinding machine 30 (FIGS. 1-3) is utilized to grind cam lobes 32 (FIGS. 4 and 5) disposed on a camshaft 34 for an internal combustion engine. The grinding machine 30 has a base 38 (FIGS. 1 and 3) with longitudinally extending parallel ways 40 and 42 (FIGS. 3 and 4) along which a work table or carriage slide 44 is movable. Movement of the work table 44 along the ways 40 and 42 positions each of the cam lobes 32 relative to a rotatable grinding wheel 48 (see FIGS. 3 and 4). The circular grinding wheel 48 is rotatably supported by bearings 50 and 52 (FIG. 4) for rotation relative to a wheel slide 54 (FIGS. 2 and 4). The wheel slide 54 is movable toward and away from the work table 44 along parallel ways 58 and 60 (FIG. 4) which movable relative to the base 38 to enable taper grinding operations to be performed.

A workpiece or camshaft support assembly 64 (FIGS. 2 and 4) is disposed on the movable carriage or work table 44. The workpiece support assembly 64 includes a longitudinally extending rocker bar 68 which is pivotally mounted on the carriage 44. A headstock or drive spindle 72 and a tailstock or dead center 74 are disposed on the rocker bar 68. The camshaft 34 is mounted between the drive spindle 72 and the tailstock 74. A motor 78 drives the headstock 72 through a non-slip universal joint assembly 80 (FIGS. 4 and 8) which allows the rocker bar 68 to pivot toward and away from the grinding wheel 48 (see FIG. 4) to accommodate the irregular configuration of the cam lobes 32.

Figure 5:
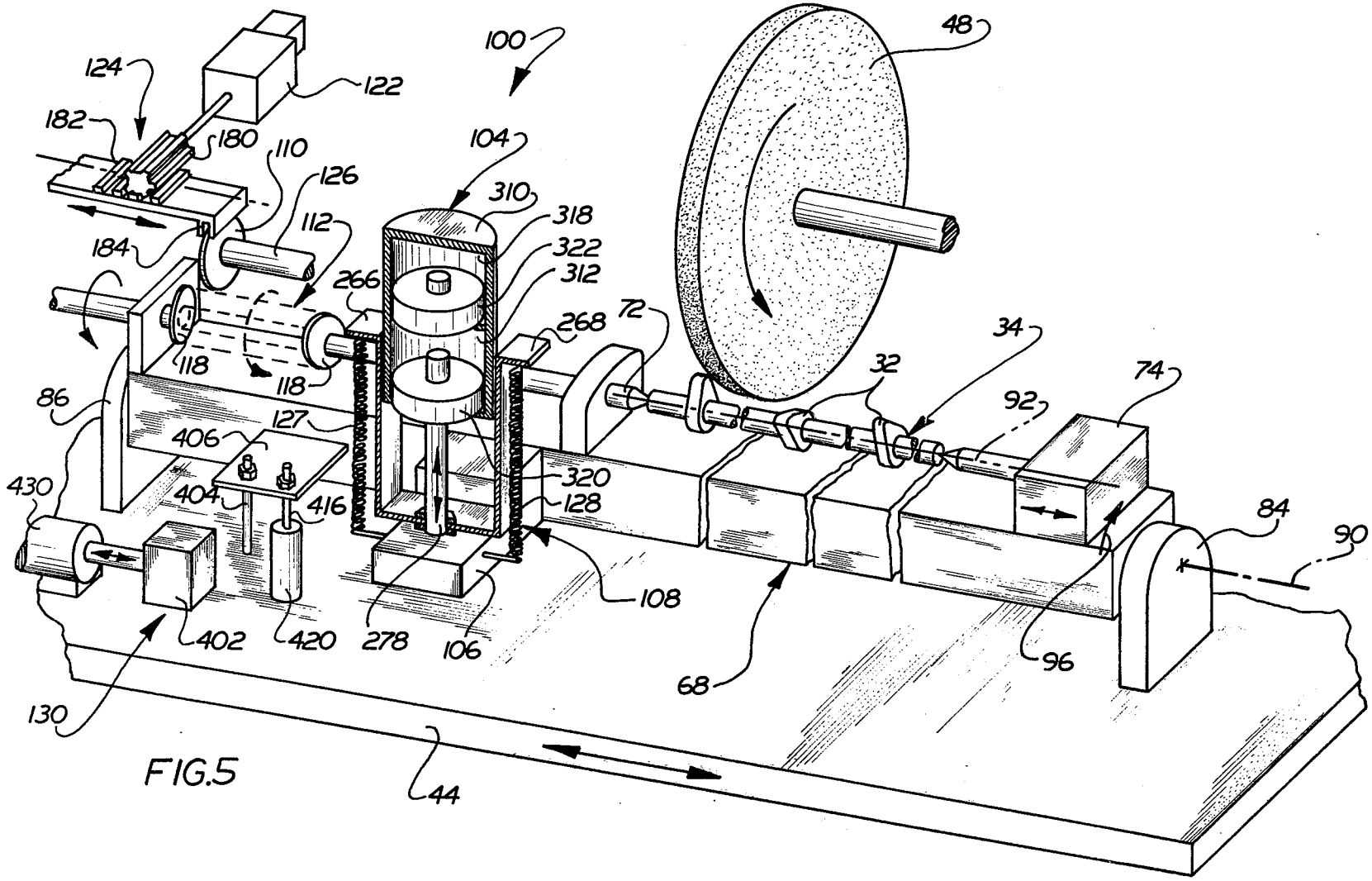
FIG. 5 is a schematicized illustration in which the spatial relationships between certain components of the grinding machine have been modified somewhat for purposes of clarity of illustration and depicting the operating relationship between a rocker bar, a motor for pivoting the rocker bar and actuating a biasing assembly, a master cam assembly, cam follower and a stop assembly.

The rocker bar 68 is pivotally connected with the carriage or work table 44 by a plurality of mounting sections 84 and 86 (see FIG. 5). The mounting sections 84 and 86 support the rocker bar 68 for pivotal movement about a horizontal axis 90 (FIG. 5) which extends parallel to the path of movement of the carriage 44 along the ways 40 and 42 on the base 38 of the grinding machine. The rocker bar pivot axis 90 is also parallel to and disposed below an axis 92 about which the camshaft 34 is rotated by the drive motor 78 and headstock 72 during a grinding operation. It should be noted that although only a pair of mounting sections are shown in FIG. 5 at the ends of the rocker bar 68, a mounting section may and preferably is, provided for the central portion of the rocker bar.

Movement of the rocker bar 68 moves the camshaft or workpiece 34 toward and away from the grinding wheel 48. Thus, the rocker bar pivots about the axis 90 from a retracted or loading position (shown in FIG. 5) through an index position to an operating position in a range of operating positions. During a camshaft grinding operation, the rocker bar 68 is pivoted in the range of operating positions to compensate for the eccentric configuration of a cam lobe 32. Between the grinding of successive cam lobes 32, the rocker bar 68 is pivoted to the index position which is adjacent to and outside of the range of operating positions. When all of the cam lobes 32 on a cam 34 have been ground, the rocker bar 68 is pivoted back to the loading position. The ground camshaft is then removed from the grinding machine 30 and a next succeeding camshaft is mounted in the workpiece support assembly 64.

A control assembly 100 (FIG. 5) is connected with the rocker bar 68 to control movement of the rocker bar relative to the carriage 44. The control assembly 100 also urges the camshaft 34 toward the grinding wheel 48 during a grinding operation. The control assembly 100 includes a motor 104 which is connected with an outwardly projecting arm 106 on the rocker bar 68 through a biasing assembly 108.

The motor 104 is operable to pivot the rocker bar from the loading or fully retracted position shown in FIG. 5 toward the grinding wheel 48 to an operating position in a range of operating positions. When a grinding operation on one cam lobe 32 has been completed, the motor 104 is operated to move the master cam assembly 12 and the rocker bar 68 away from the follower roll 110 to the index position. This motion also provides clearance between the grinding wheel 48 and the camshaft 34. When all of the cam lobes 32 have been ground, the motor 104 moves the rocker bar 68 back to the loading position.

When the rocker bar 68 is at the index position, the carriage 44 can be moved relative to the grinding wheel 48 without interference between the cam lobes 32 and the grinding wheel. In addition, a cam follower 110 can be freely moved axially relative to a master cam assembly 112 without interference between the cam follower and the master cam assembly.

The master cam assembly 112 cooperates with the cam follower 110 when the rocker bar 68 is in the range of operating positions to move the rocker bar toward and away from the grinding wheel 48 in a manner which is a function of the desired configuration of a cam lobe 32. Thus, the master cam assembly 112 (FIG. 5) is mounted on the rocker bar 68 in a coaxial relationship with the camshaft 34. The master cam assembly 112 engages the cam follower 110 when the rocker bar 68 is in the range of operating positions. During grinding of a cam lobe 32, the master cam assembly 112 is rotated about the axis 92 at the same speed as the camshaft 34 by the universal drive 80 (see FIGS. 4 and 8). Rotation of the master cam assembly 112 relative to the cam follower 110 causes the rocker bar 68 to be pivoted toward and away from the grinding wheel 48 to compensate for the eccentric configuration of the cam lobes 32 in a known manner.

Figure 8:
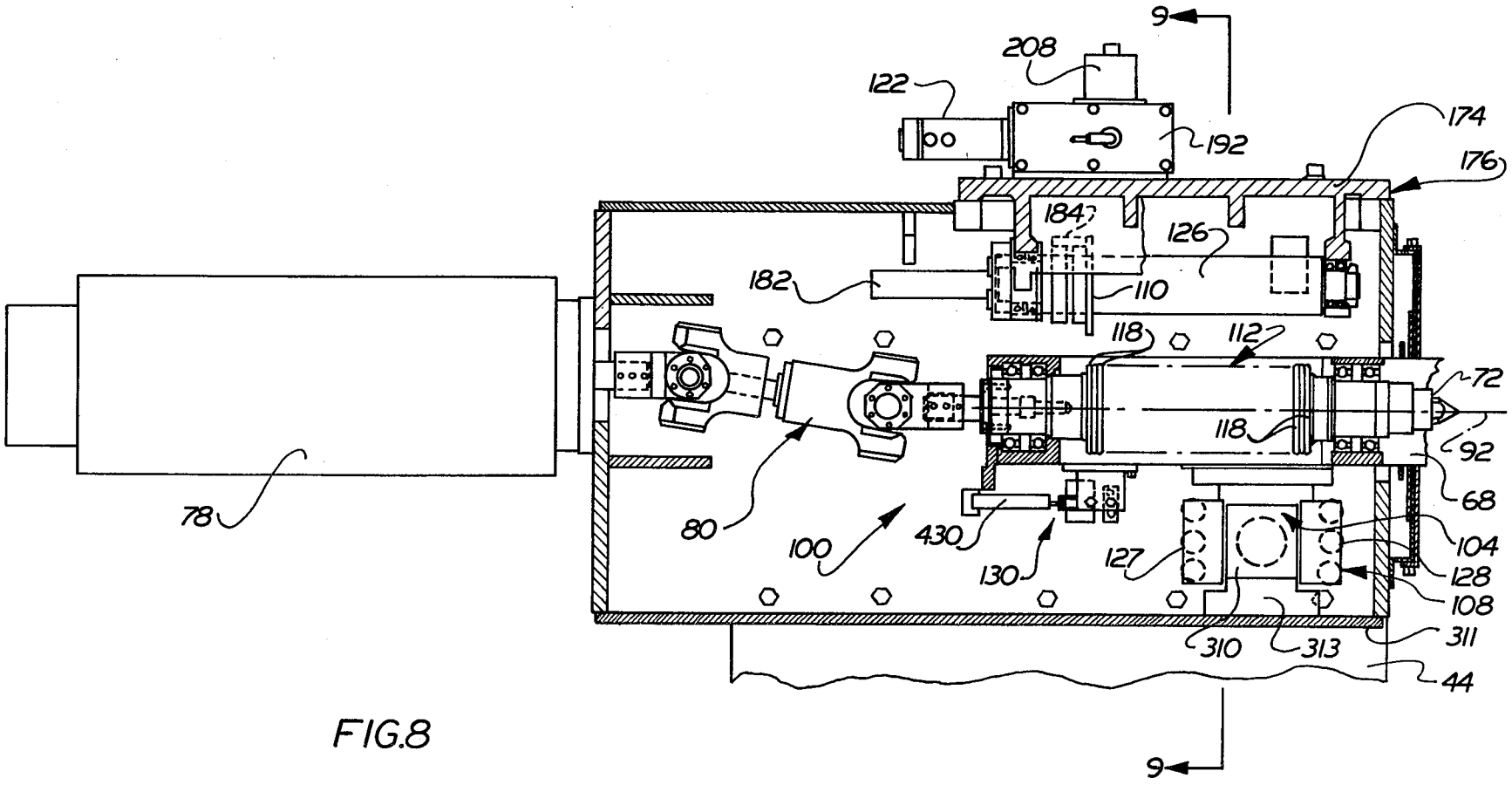
FIG. 8 is an enlarged plan view of one preferred embodiment of a portion of the apparatus shown in FIG. 5 and illustrating the relationship between the rocker bar, the motor for pivoting the rocker bar and actuating the biasing assembly, the master cam assembly, the cam follower, the stop assembly and a drive assembly which rotates the master cam assembly and a camshaft.

Although the master cam assembly 112 could have many different constructions, it is machined from a single piece of metal and includes a plurality of master cam elements 118 (see FIGS. 5 and 8). Each of the master cam elements 118 has a configuration and angular orientation relative to the axis 92 which is a function of the configuration and angular orientation of an associated one of the cam lobes 32. There maybe two master cam elements 118 for each of the lobes 32 on the camshaft 34. Two master cam elements 118 are provided for each cam lobe 32 to compensate in a known manner for differences in the geometry of the grinding machine 30 with changes in the diameter of the grinding wheel 48. Thus, when the grinding wheel 48 is new and has a relatively large diameter, one of the two cam elements in the master cam 112 is engaged by the follower 110. When the grinding wheel becomes worn, the follower is shifted to the other cam element 118 which is associated with a particular lobe of the camshaft 34.

In addition to master cam elements 118 for cam lobes 32 which actuate intake and exhaust valves, master cam elements 118 can be provided for lobes on the camshaft 34 which drive auxiliary equipment associated with an engine. Thus for a V-8 engine having cam lobes for actuating intake and exhaust valves, a fuel injector pump and an oil pump, the master cam assembly 112 would have 36 cam elements 118. Sixteen of the master cam elements 118 would be associated with the cam lobes which actuate intake valves and another sixteen of the master cam elements 118 would be associated with cam lobes 32 which actuate exhaust valves. In addition, a pair of master cam elements 118 would be associated with the fuel pump cam and a pair of master cam elements 118 would be associated with the oil pump cam. Of course, the number of cam elements 118 will vary depending upon the number of lobes on a camshaft which is to be ground by the grinding machine 30. In addition, it should be understood that, if desired, the master cam assembly 112 can be constructed in many different ways other than being machined from a single piece of metal.

In accordance with a feature of the present invention, the cam follower 110 (FIG. 5) is moved relative to the master cam assembly 112 independently of movement of the carriage or work table 44 relative to the base 38 of the grinding machine. Thus, a cam follower drive motor 122 is operable to actuate a rack and pinion drive assembly 124. The drive assembly 124 is connected with the cam follower 110 to move the cam follower axially along a stationary support rod 126 which extends parallel to the axis 92 about which the master cam assembly 112 rotates.

Since the cam follower 110 is moved by the motor 122, the cam follower can be aligned with any desired cam element 118 in the master cam assembly 112 by merely operating the motor to shift the cam follower relative to the master cam assembly when the rocker bar 68 is in either the fully retracted position or the index position. It should be noted that cam follower 110 is not shifted relative to the master cam assembly 112 when the rocker bar 68 is in an operating position. This is because an outwardly projecting nose on one of the master cam elements 118 may interfere with movement of the cam follower 110. When the rocker bar 68 is in either the fully retracted or the index position, the spacing between the master cam assembly 112 and cam follower 110 is sufficient to enable the outwardly projecting nose portions of the cam elements 118 to clear the cam follower 110.

In accordance with still another feature of the present invention, the biasing assembly 108 (FIG. 5) is effective to urge the rocker bar 68 toward the grinding wheel 48 with a relatively large force during a rough grinding operation and to urge the rocker bar toward the grinding wheel with a relatively small force during a finish grinding operation. During a rough grinding operation, the grinding wheel 48 removes material at a relatively high rate from the cam lobe 32. In order to maintain this relatively high rate of material removal, the cam lobe 32 must be pressed firmly against the grinding wheel 48. However, during a finish grinding operation, material is removed from the cam lobe 32 at a much lower rate and the cam lobe is pressed against the grinding wheel with a smaller force.

Reducing the force with which the biasing assembly 108 urges the rocker bar 68 toward the grinding wheel 48, that is in the direction of the arrow 96 in FIG. 5, reduces the force with which the master cam assembly 112 presses against the cam follower 110. By reducing the force with which the master cam assembly 112 presses against the cam follower 110, the deflection of various components of the grinding machine 30 is reduced. Therefore, reducing the force which the biasing assembly 108 applies to the rocker bar 68 during a finish grinding operation increases the accuracy of the finish grinding operation.

The biasing assembly 108 is actuated by the motor 104 to vary the rocker bar biasing force. Thus, during a rough grinding operation, the motor 104 resiliently stretches two sets 127 and 128 (FIG. 5) of springs to a relatively large extent to apply a large biasing force to the rocker bar 68. During a finish grinding operation, the motor 104 resiliently stretches the spring sets 127 and 128 to a lesser extent to reduce the biasing force applied to the rocker bar 68.

In accordance with still another feature of the present invention, it is unnecessary to move the rocker bar 68 all the way back to the fully retracted or loading position before the cam follower 110 is indexed relative to the master cam assembly 112. Thus, a stop assembly 130 is operable to limit return movement, that is in the direction opposite the arrow 96 in FIG. 5, of the rocker bar 68 between the grinding of successive lobes 32 on the camshaft 34. However, the arcuate distance through which the rocker bar 68 moves from the range of operating positions to the index position is sufficient to move the master cam elements 118 clear of the cam follower 110. By reducing the distance through which the rocker bar 68 is pivoted away from the range of operating positions, the time required between the grinding of each of the successive cam lobes 32 is reduced with a resulting increase in the productivity of the grinding machine 30.

Work Table and Wheel Slide Drives

Figure 6:
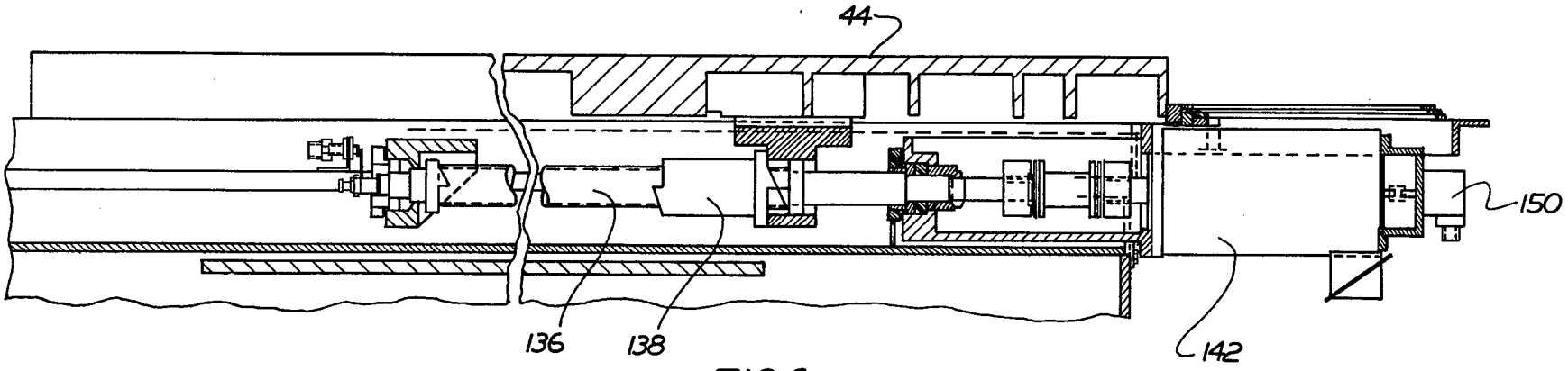
FIG. 6 is a sectional view illustrating the relationship between a motor and a drive assembly for moving the carriage or work table relative to a base.

The work table or carriage 44 is moved along the ways 40 and 42 (see FIGS. 3 and 4) by means of a drive screw 136 (see FIGS. 4 and 6) which extends parallel to the ways 40 and 42 and engages a drive nut 138 (FIG. 6). When the work table or carriage 44 is to be moved along the ways 40 and 42, a reversible motor 142 is energized to rotate the drive screw 136. The operation of the motor 142 is controlled by a computer 146 (see FIG. 4). During rotation of the drive screw 136 by the motor 142, a signal generator 150 (FIGS. 4 and 6) provides an output signal to the computer 146 to indicate the position of the table 44 relative to the ways 40 and 42. The manner in which the computer 146 cooperates with the motor 142 and signal generator 150 is well known and is similar to that described in U.S. Pat. No. 4,115,958 and will not be further described herein in order to avoid prolixity of description.

Figure 7:
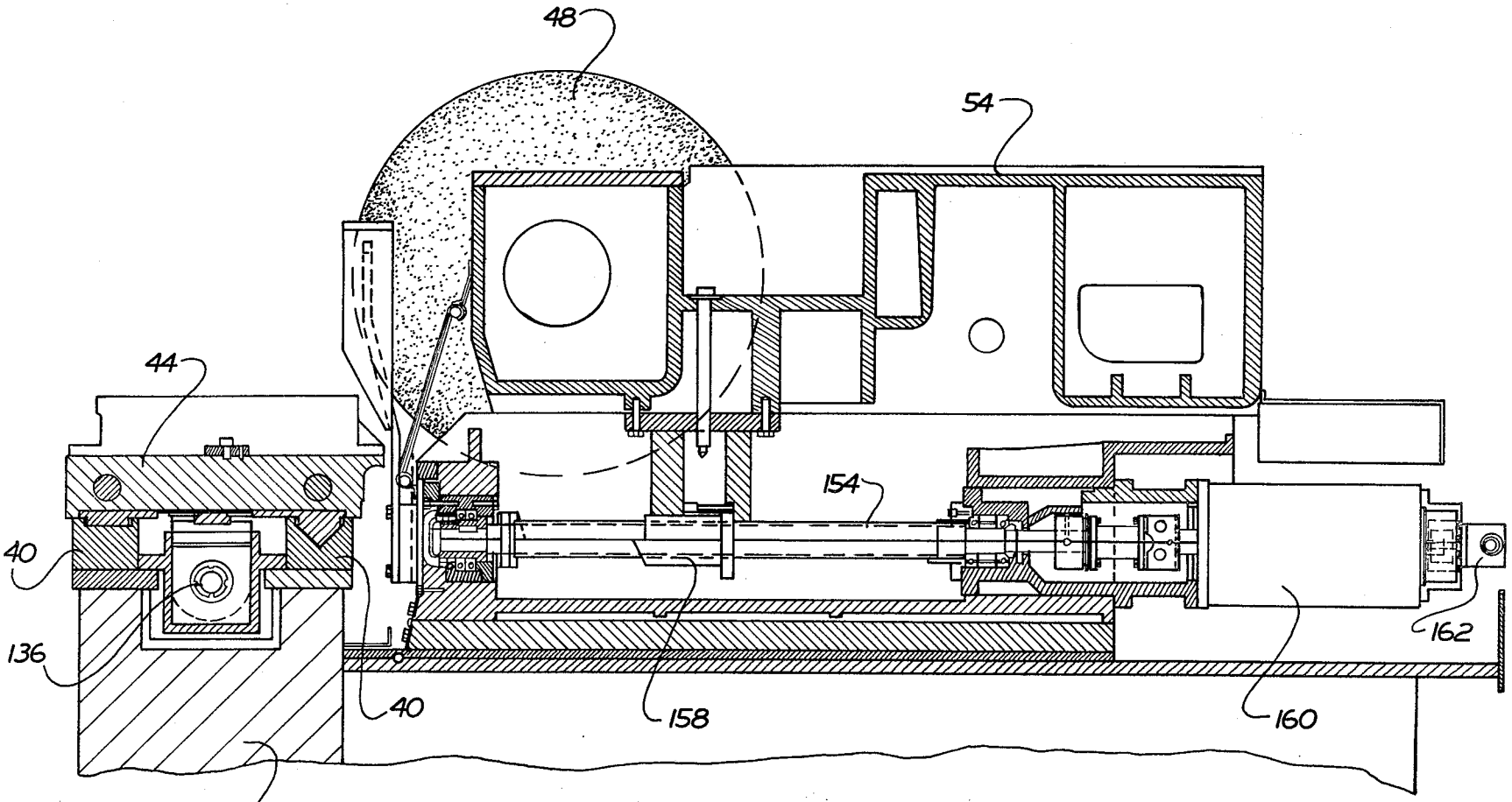
FIG. 7 is a fragmentary sectional view illustrating the relationship between the work table, a carriage or wheel slide upon which the grinding wheel is mounted and a drive assembly for the wheel slide.

The grinding wheel slide 54 is moved along the ways 58 and 60 by a drive screw 154 (FIGS. 4 and 7). The drive screw 154 extends parallel to the ways 58 and 60 and transversely to the ways 40 and 42 along which the table 44 moves. The drive screw 154 (see FIG. 7) cooperates with a nut 158 which is connected with the wheel slide or carriage 54. Therefore, upon rotation of the drive screw 154 by a reversible drive motor 160, the grinding wheel 48 is moved toward and away from the work table 44. A signal generator 162 is connected with the motor 160 and drive screw 154 to provide signals to the computer 146 (FIG. 4) to enable it to determine the position of the grinding wheel 48 relative to the work table 44.

The grinding wheel 48 is rotatably mounted on the wheel slide 54 and is driven by a motor 166 through a drive belt 168. The speed at which the motor 166 drives the grinding wheel 48 can be varied by the computer 146 to accommodate different grinding conditions. A control console 170 is connected with the computer 146 and is manually actuatable to provide input data to the computer.

Cam Control Assembly

The construction of the master cam assembly 112, cam follower 110 and follower drive assembly 124 is illustrated in FIGS. 8–13. The master cam assembly 112 (FIG. 8) is mounted on the rocker bar 68 in a coaxial relationship with the headstock 72 and is rotated about the axis 92 at the same speed as the camshaft 34. Therefore, the master cam elements 118 rotate about the axis 92 at the same speed as do the cam lobes 32.

The cam follower 110 is slidably mounted on the support shaft 126 which is fixedly mounted on a vertical sidewall 174 of a housing 176 on the work table 44. Therefore, once the cam follower 110 has been moved into axial alignment with a selected one of the master cam elements 118, movement of the rocker bar 68 from the loading position (FIG. 8) to an operating position moves the selected cam element 118 into abutting engagement with the cam follower 110. Rotation of the selected master cam element 118 with the camshaft 34 causes the master cam assembly 112 to reciprocate back and forth to oscillate the rocker bar 68 about the rocker bar pivot axis 90 (FIG. 5). This oscillation of the rocker bar 68 moves the camshaft 34 toward and away from the grinding wheel 48 in a manner which is a function of the desired configuration for the cam lobe 32 which is presently being ground. The general manner in which the master cam assembly 112 cooperates with the cam follower 110 to oscillate the rocker bar 68 is the same as is disclosed in U.S. Pat. Nos. 2,535,130 and 2,786,311.

In accordance with one aspect of this invention, the cam follower 110 is indexed relative to the master cam 112 by the reversible drive motor 122 (FIGS. 5 and 8). This enables the cam follower 110 to be moved in either direction along the support bar 126 independently of movement of the work table or carriage 44 relative to the base 38 of the grinding machine 30. In fact, the motor 122 can be operated to move the cam follower 110 axially along the shaft 126 while the carriage 44 is stationary. This freedom of movement for the cam follower 110 enables the cam elements 118 to be selected in a desired order. In addition, the same cam element 118 can be selected to effect movement of the rocker bar 68 during the grinding of a plurality of identical cam lobes 32.

Figure 9:
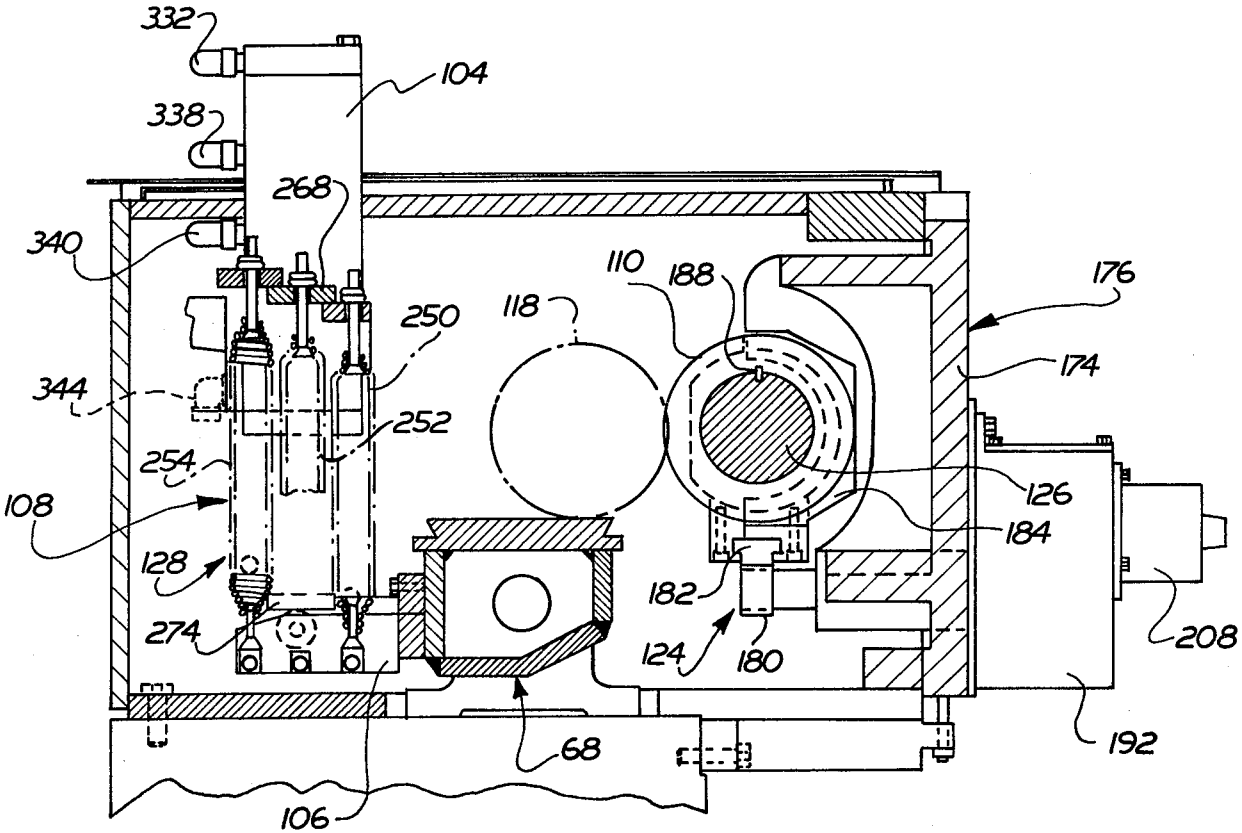
FIG. 9 is an enlarged sectional view, taken generally along the line 9—9 of FIG. 8, further illustrating the relationship between the rocker bar, the master cam assembly, the cam follower, the biasing assembly, and the motor for pivoting the rocker bar and actuating the biasing assembly.
Figure 11:
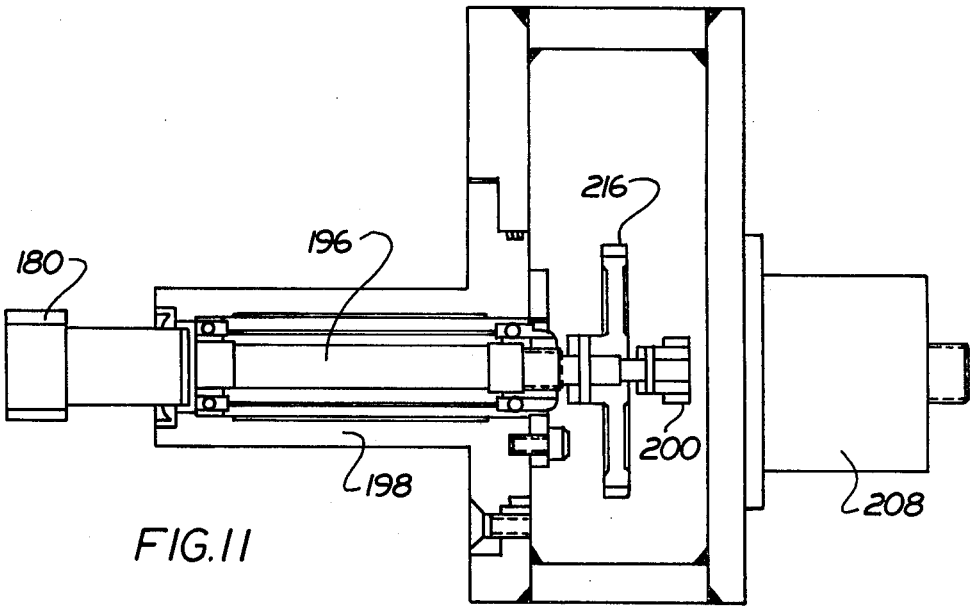
FIG. 11 is a sectional view further illustrating the construction of a portion of the cam follower drive assembly of FIG. 10.

The rack and pinion drive assembly 124 for moving the cam follower 110 along the shaft 126 is shown in FIG. 9. The drive assembly 124 includes a rotatable pinion gear 180 which is disposed in meshing engagement with a rack gear 182 (FIGS. 8 and 9) which is fixedly connected with a bracket 184 (FIG. 9). The bracket 184 is connected with the cam follower 110. Therefore, upon rotation of the pinion gear 180, the rack gear 182 moves the bracket 184 and cam follower 110 along the stationary shaft 126. It should be noted that a key 188 (FIG. 9) is provided to hold the cam follower 110 against rotational slippage relative to the shaft 126. Therefore, the angular position of the cam follower 110 relative to the master cam assembly 112 remains constant with movement of the cam follower 110 along the shaft 126.

Figure 10:
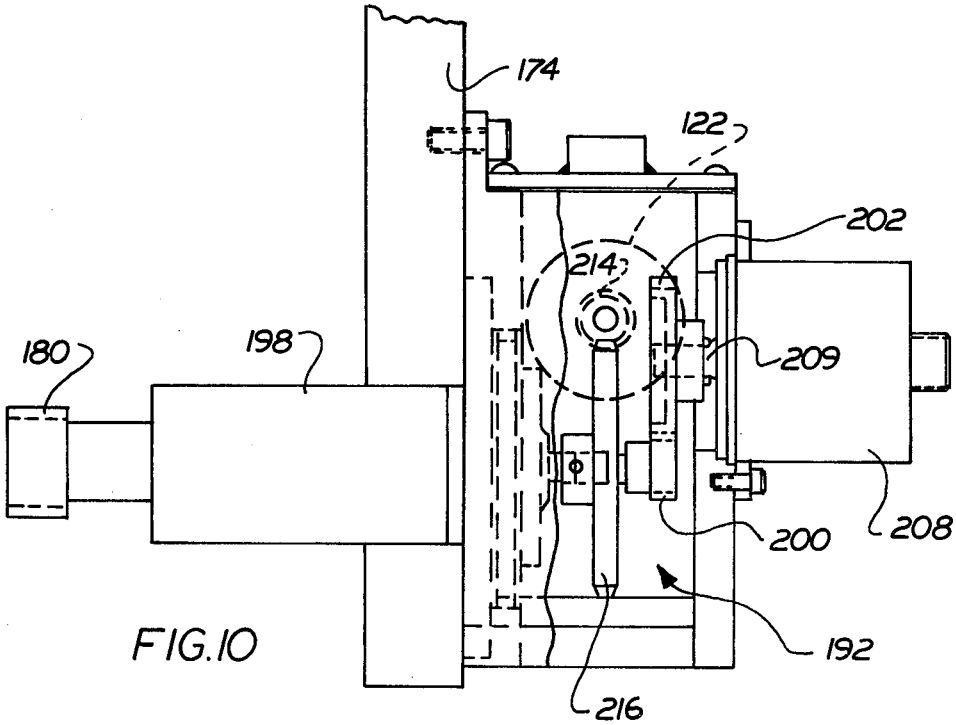
FIG. 10 is a sectional view illustrating the construction of the drive assembly for moving the cam follower relative to the master cam assembly.
Figure 12:
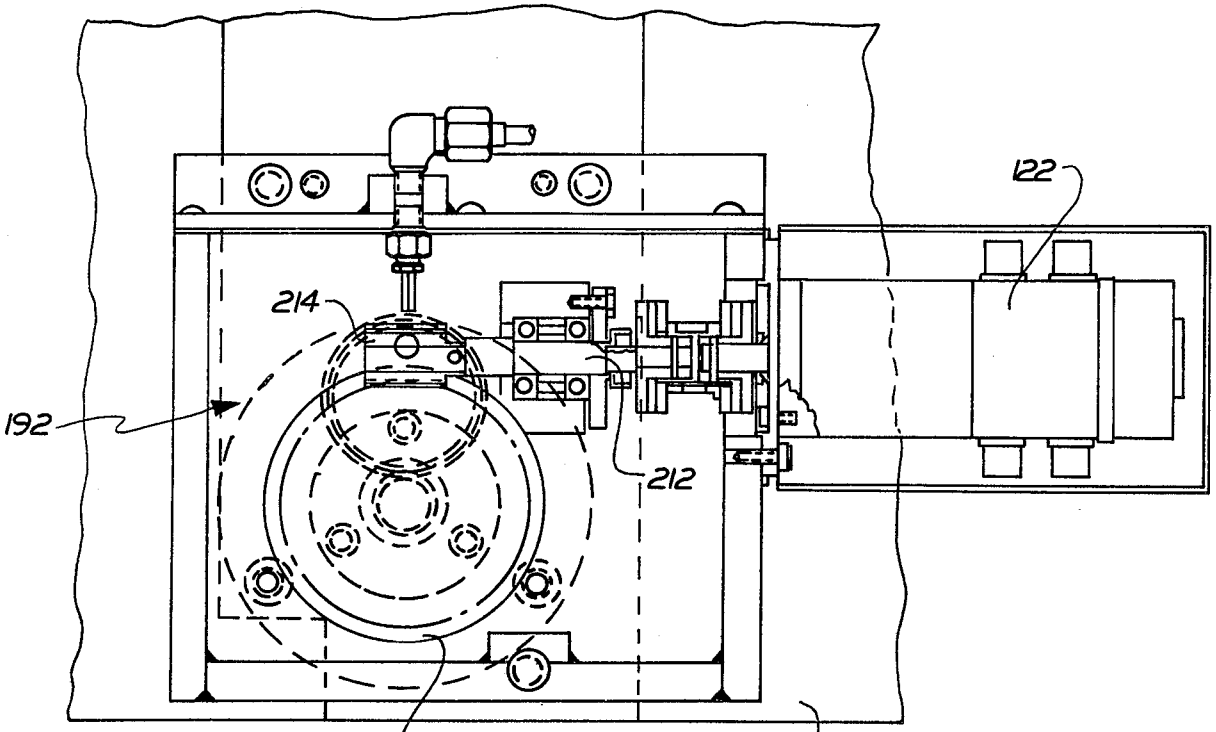
FIG. 12 is a sectional view illustrating the manner in which a motor is connected with the cam follower drive assembly of FIG. 10.
Figure 13:
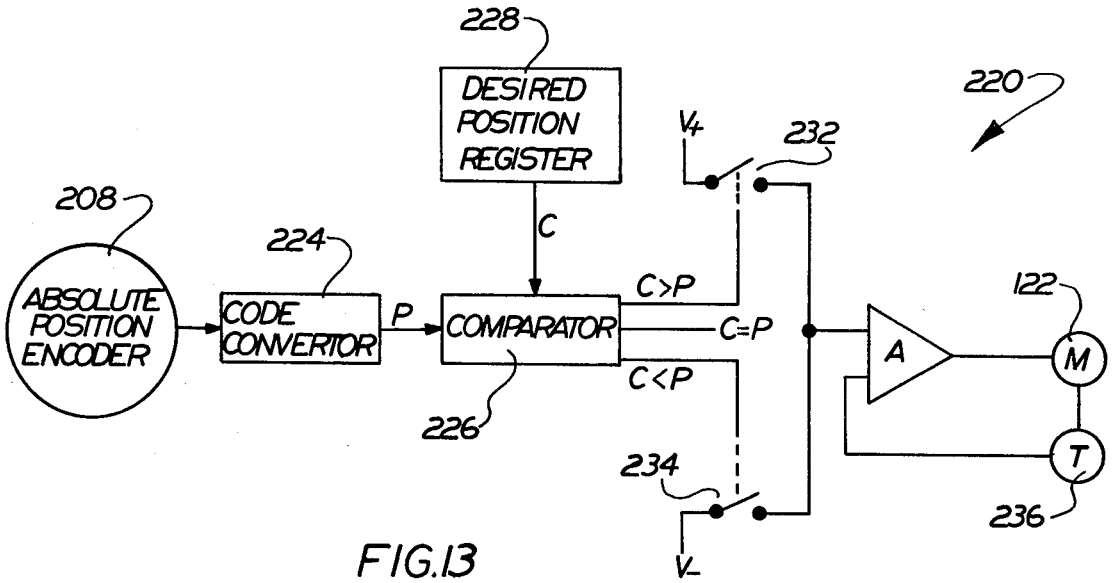
FIG. 13 is a schematic illustration of control circuitry utilized in association with the cam follower drive mechanism of FIGS. 10–12.
Figure 14:
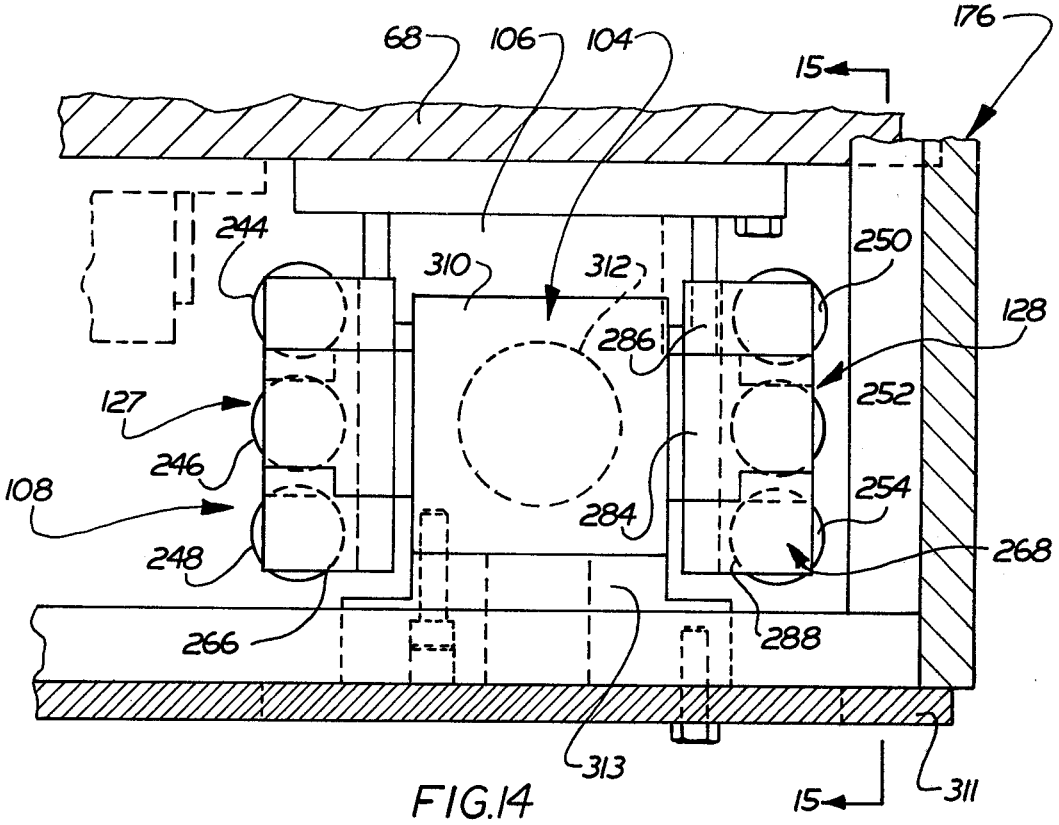
FIG. 14 is a top plan view of the motor which pivots the rocker bar relative to the work table and the biasing assembly which urges the rocker bar toward the grinding wheel during a grinding operation.

The servo motor 122 drives the pinion gear 180 through a reduction gear assembly 192 which is mounted on the sidewall 174 of the housing 176 (see FIGS. 8, 10 and 12). Thus, the pinion gear 180 is fixedly connected with a drive shaft 196 (FIG. 11) which is rotatably supported in a tubular housing 198. A gear 216 is disposed on the shaft 196 in meshing engagement with a worm gear 214 (FIGS. 10 and 12) connected with the motor 122 by a drive shaft 212. Therefore, upon operation of the motor 122, the gears 214 and 216 cooperate to rotate the shaft 196 and the pinion gear 180.

An encoder 208 (see FIGS. 8 and 12) is driven in synchronism with the drive motor 122 and pinion gear 180. The output from the encoder 208 indicates the exact position of the cam follower 110 relative to the master cam 112. This enables the actual position of the cam follower 110 to be compared with the desired position of the cam follower. The servo motor 122 is operated to eliminate any difference between the actual and desired positions of the cam follower 110.

The encoder 208 is connected with the motor 122 and pinion gear 180 through the gear assembly 192 (FIG. 10). The encoder 208 has a drive shaft 209 (FIG. 10) which is connected with a code disk in the encoder 208. The shaft 209 is driven by a gear 202 which is disposed in meshing engagement with a gear 200. The gear 200 is connected with the shaft 196 and pinion gear 180 which drives the rack gear 182 to move the cam follower 110 (see FIGS. 9–12). Therefore, the encoder 208 is driven in synchronism with the motor 122 and the cam follower 110 so that the output from the encoder is indicative of the actual position of the cam follower 110 relative to the master cam assembly 112.

A control circuit 220 (see FIG. 13) is provided to compare the actual position of the cam follower 110 with the desired position and to effect operation of the drive motor 122 if the position indicated by the encoder 208 is different from the desired position. Thus, the encoder 208 is preferably an eight-bit absolute position encoder which provides an output signal indicative of the position of the cam follower 110 relative to the master cam assembly 112. The output from the encoder or position transducer 208 is a grey binary code which is transmitted to a binary converter 224. The output from the binary converter 224 is transmitted to a comparator 226 as signal P indicating the actual position of the cam follower 110 relative to the master cam assembly 112. The other input to the comparator 226 is from a desired position register 228. The register 228 has an output signal C indicative of a commanded or desired position for the cam follower 110 relative to the master cam assembly.

If the cam follower 110 is at the commanded position, the output from the comparator 226 results in a zero change signal and the motor 122 remains de-energized. However, if the cam follower 110 is not at the commanded position, the comparator 226 provides an output which actuates an analog switch 232 or 234. Actuation of a switch 232 or 234 energizes the motor 122 to drive the cam follower toward the desired position. A tachometer 236 provides a feedback signal to facilitate the rapid response of the cam follower drive motor 122. Although the control circuitry 220 has been shown in FIG. 13 as being separate from the computer 146 (FIG. 4), it is contemplated that the code converter 224, comparator 226 and position register 228 would be included in the computer 146 if desired.

Since the drive motor 122 can be energized to move the cam follower 110 to a desired position independently of movement of the carriage or work table 44, the necessity of placing the cam elements 118 on the master cam 112 in the same order as in which the corresponding lobes 32 appear on the camshaft 34 is eliminated. In addition, the dogs which are provided on the known cam grinding machine to actuate a star wheel which drives the cam follower are eliminated. Eliminating the dogs which actuate the cam follower drive in a known grinding machine greatly facilitates setting up of the grinding machine to grind cams having different distances between the cam lobes 32. In addition, the mechanical cam follower drive arrangements which can malfunction are eliminated. The encoder 208 provides an output signal which is indicative of the position of the cam follower relative to the master cam at any time during operation of the grinding machine 30. Although it is preferred to provide an encoder 208 in association with the cam follower drive motor 122 to provide absolute control system, it is contemplated that an incremental control system or a potentiometer, etc. could be utilized in association with the cam follower drive motor 122 if desired.

Biasing Assembly

The biasing assembly 108 (see FIGS. 5 and 14–16) is effective to urge the lobe 32 on the camshaft 34 toward the grinding wheel 48 with a relatively large force during a rough grinding operation in which material is removed at a relatively high rate from the cam lobe 32. During a finish grinding operation in which material is removed at a lower rate, the biasing assembly 108 urges the cam lobes 32 toward the grinding wheel 48 with a relatively small force. Since the material is being removed at a relatively low rate during the finish grinding operation, the operating forces between the cam lobe and grinding wheel 48 are substantially less than during a rough grinding operation.

The biasing assembly 108 includes two sets 127 and 128 (FIGS. 14 and 16) of three equal length springs. Thus, the spring set 127 includes coil springs 244, 246 and 248 of while the spring set 128 includes the springs 250, 252 and 254 (see FIG. 14). The coil springs 244–254 all have the same free length.

The two spring sets 127 and 128 are connected with the motor 104 and the arm 106 (FIG. 15) which extends outwardly from the rocker bar 68. Thus, the arm 106 which extends outwardly from the rocker bar 68 has a pair of sections 260 and 262 (see FIG. 16) to which the lower end portions of the springs 244–254 are connected. The upper end portions of the springs 244–254 are connected with outwardly extending flanges 266 and 268 (FIGS. 14 and 16) formed on the upper end portions of the opposite legs 270 and 272 (FIG. 16) of a generally U-shaped mounting bracket 274. The bight or midsection 276 of the bracket 274 is connected with a piston rod 278 of the motor 104.

Figure 15:
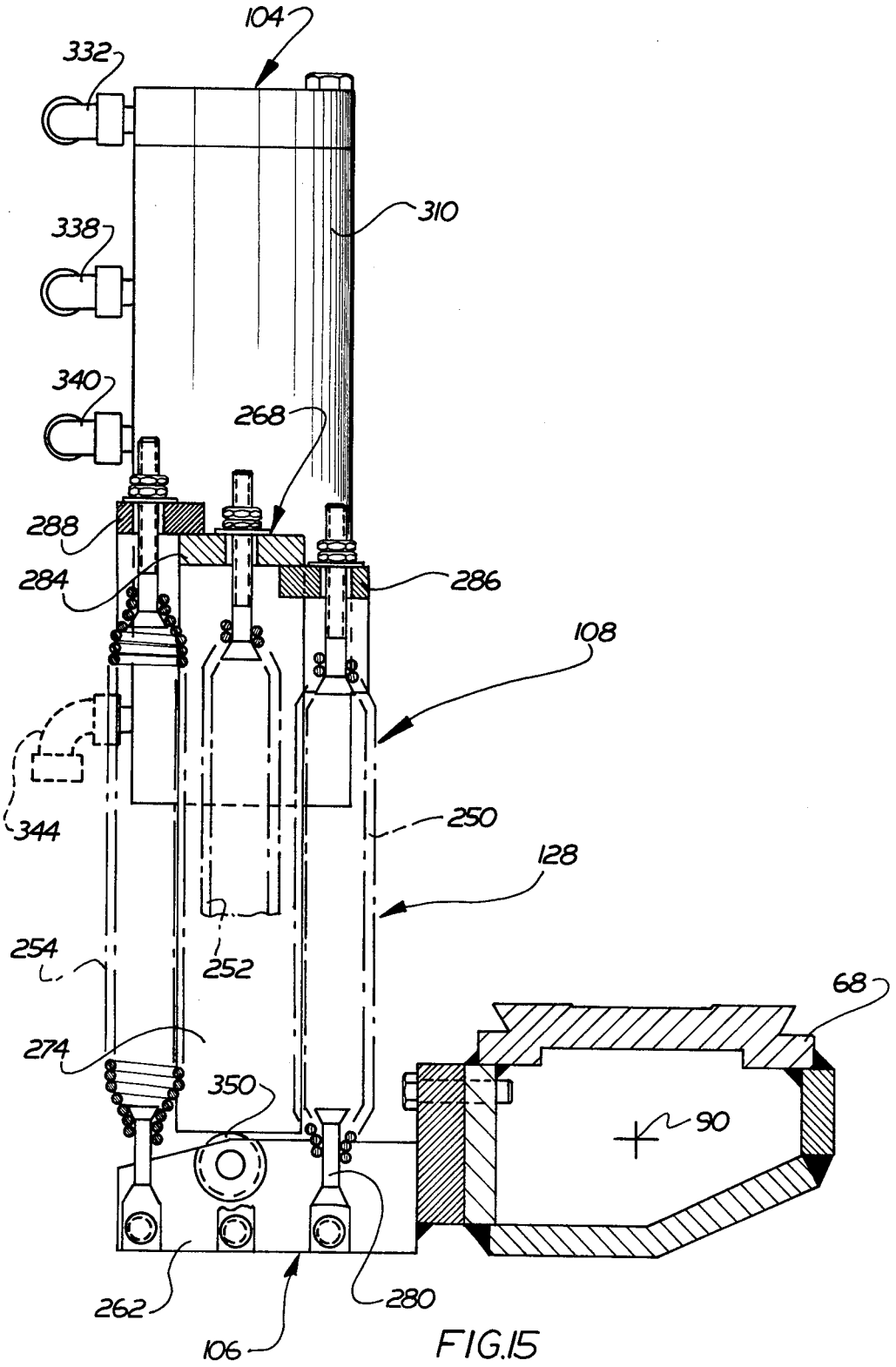
FIG. 15 is an elevational view, taken generally along the line 15—15 of FIG. 14, further illustrating the relationship between the rocker bar, motor and biasing assembly when the rocker bar is in the fully retracted or loading position.
Figure 17:
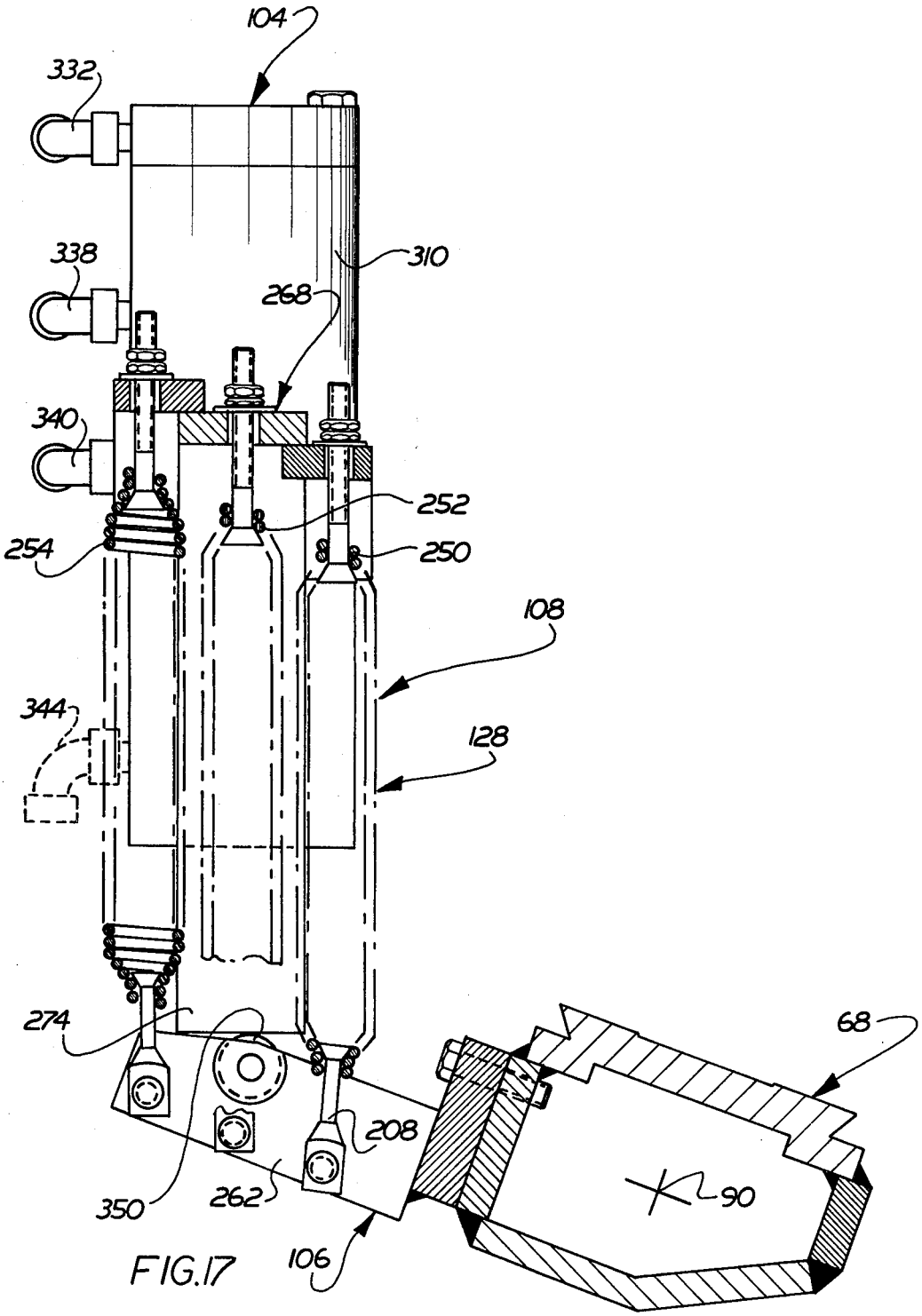
FIG. 17 is an elevational view, generally similar to FIG. 15, illustrating the relationship between the rocker bar, motor, and biasing assembly when the rocker bar is in an operating position in which a lobe on a camshaft is engaged by the grinding wheel.

The arm 106 to which the spring sets 127 and 128 are connected pivots about the central axis 90 (FIGS. 5 and 15) of the rocker bar 68. Therefore, the lower end portions of the outer springs 248 and 254 (FIG. 14) are rotated about the axis 90 through a greater distance than are the inner springs 244 and 250 when the arm 106 is pivoted about the axis 90 (FIG. 17). To accommodate the different distances which the equal length springs 244–254 are rotated about the axis 90 by pivotal movement of the arm 106 from the position shown in FIG. 15 to the position shown in FIG. 17, the U-shaped bracket 274 has flanges 266 and 268 with offset sections. In addition, the inner springs 244 and 250 are connected with the arm 106 at their lower end portions by connections which allow the lower ends of the springs 244 and 250 to move relative to the arm 106 (FIG. 15).

Accordingly, the center spring 252 of the set of springs 128 (see FIG. 15) is connected with a center or main section 284 of the flange 268. The inner spring 250 is connected with a section 286 which is disposed below the main section 284 of the flange 268. Similarly, the outer spring 254 is connected with a section 288 which is disposed above the center section 284. The inner spring 250 is connected with the arm 106 by connecting rod 280 in a manner which allows movement to occur between the lower end of the spring 250 and the connecting rod 280. Although only the mounting flange for the spring set 128 has been shown in FIG. 15, it should be understood that the flange 266 for the spring set 127 has substantially the same construction as the flange 268.

Motor Assembly

The motor assembly 104 cooperates with the biasing assembly 108 and the rocker bar 68 to perform the dual functions of moving the rocker bar toward and away from the grinding wheel 48 and of actuating the biasing assembly 108. The motor assembly 104 includes a stationary housing 310 which is connected with the side wall 311 of the housing 176 (FIG. 8) by a mounting flange 313. The motor housing 310 has a cylindrical main chamber 312 (FIG. 16) which is divided into three variable volume chambers 314, 316 and 318 by a pair of relatively movable cylindrical pistons 320 and 322.

A valve assembly 326 (see FIG. 16) is provided to control the porting of fluid to the various variable volume chambers 314, 316 and 318 in the motor housing 310. Thus during loading and unloading of camshafts 34, the motor 104 is operated to move the rocker bar 68 to the fully retracted or loading position of FIGS. 5 and 15. At this time the valve assembly 326 and motor 104 are in the condition shown in FIG. 16.

Operation

Figure 16:
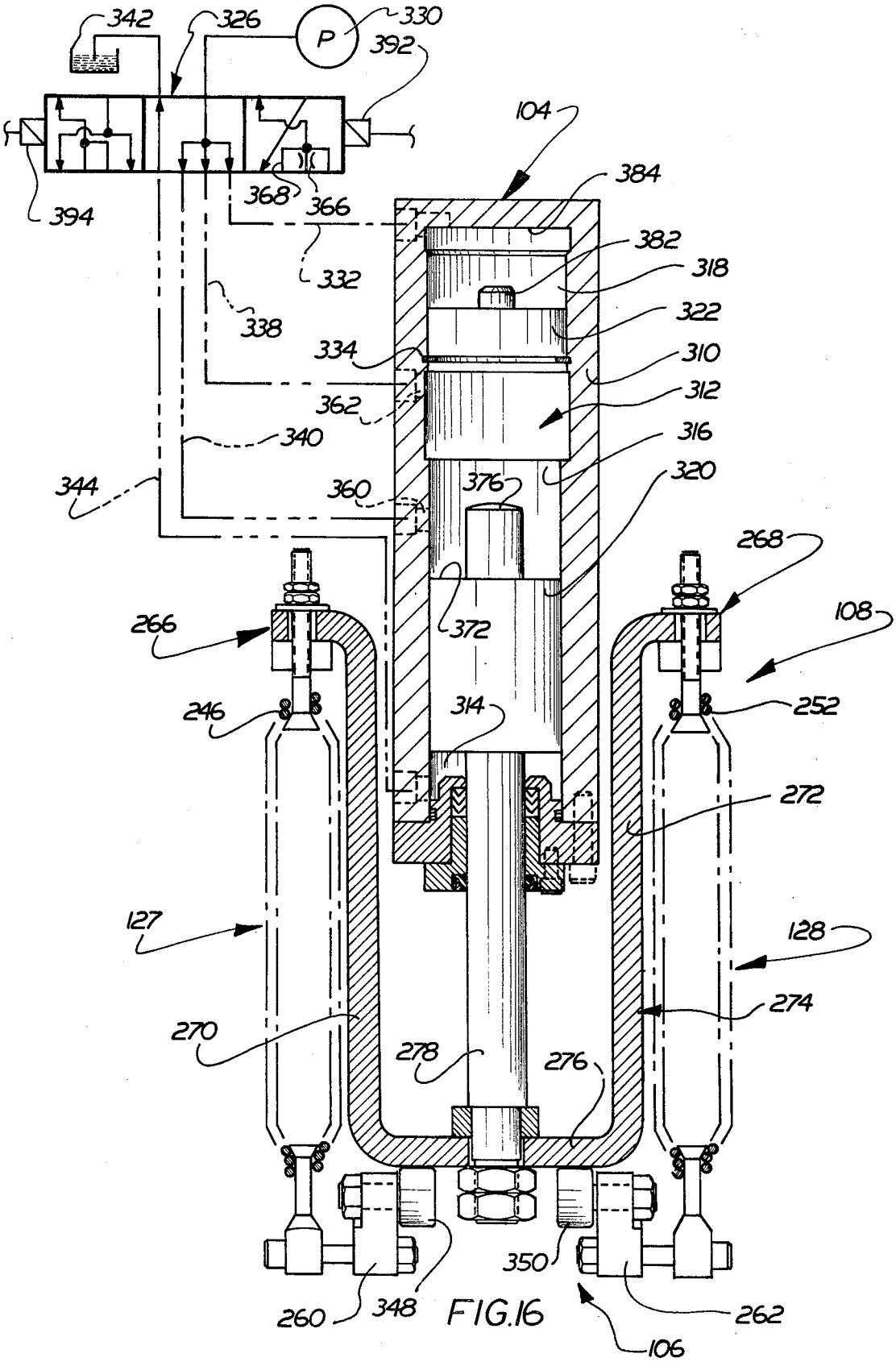
FIG. 16 is a fragmentary sectional view illustrating the relationship between the motor and biasing assembly when the rocker bar is in the loading position.

When the valve assembly 326 is in the initial condition of FIG. 16, high pressure fluid is conducted from a pump 330 through a conduit 332 to the upper variable volume chamber 318. This high pressure fluid urges the relatively short cylindrical secondary piston 322 downwardly against an annular stop ring 334. In addition, high pressure fluid is conducted through conduits 338 and 340 to the relatively large central variable volume chamber 316. This fluid pressure is effective to force the cylindrical main piston 320 downwardly to the fully extended position. At this time, the variable volume chamber 314 is connected with reservoir or drain 342 through a conduit 344.

When the main piston 320 is in the extended position shown in FIG. 16, the piston rod 278 presses the bracket 274 downwardly against rollers 348 and 350 on the two sections 260 and 262 of the arm 106 which is connected with the rocker bar 68. The downward force of the bracket 274 against the rollers 348 and 350 on the arm 106 holds the rocker bar 68 in the loading or fully retracted position shown in FIGS. 5 and 15. At this time, the headstock 72 and tailstock 74 are spaced a substantial distance from the grinding wheel 48 (FIG. 5) to enable a camshaft 34 to be readily mounted on the rocker bar 68. In addition, the master cam assembly 112 is spaced from the cam follower 110 (FIGS. 5 and 8) so that the cam follower can be indexed relative to the master cam assembly without interference between the cam follower and the cam elements 118.

Figure 18:
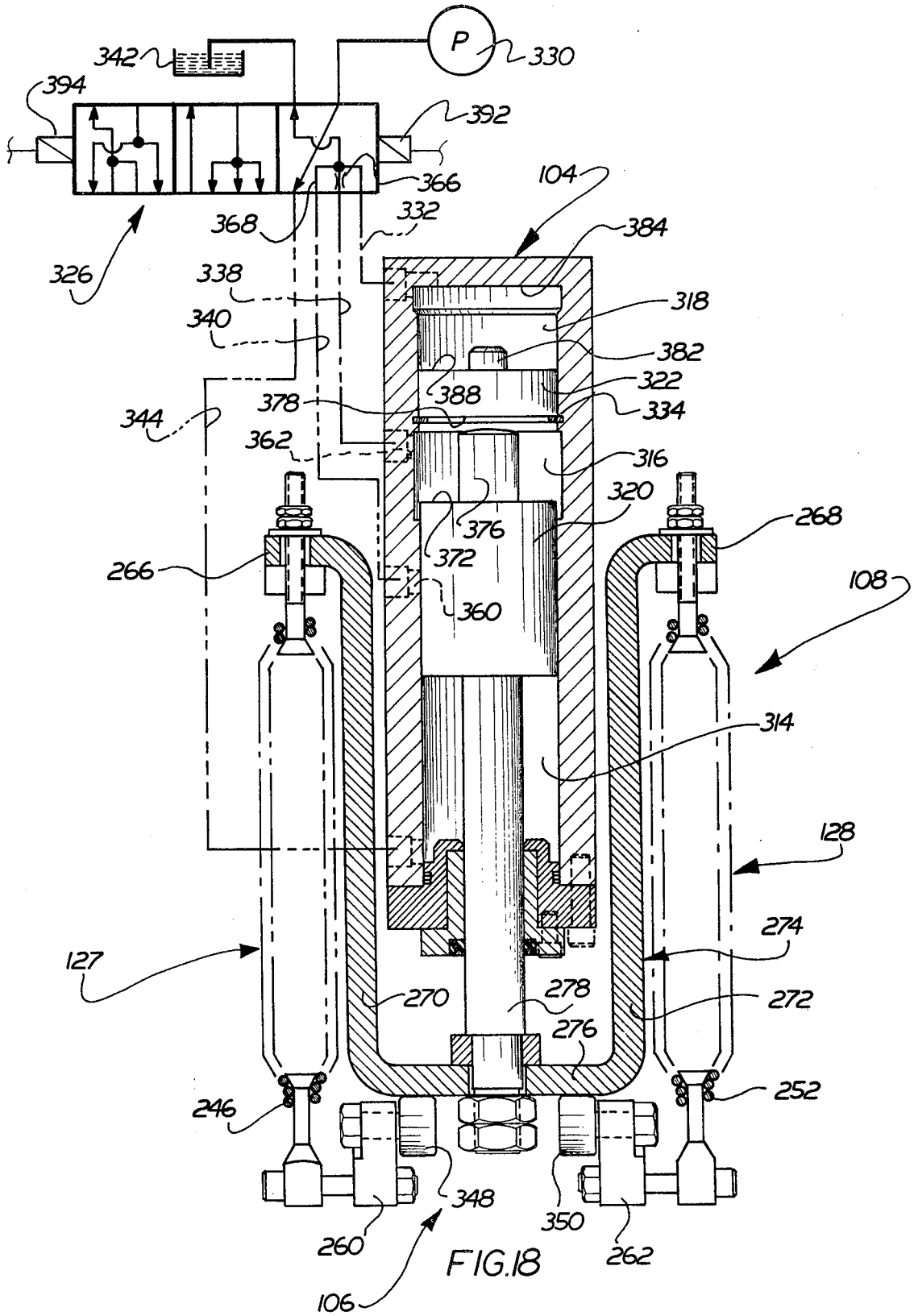
FIG. 18 is a sectional view, generally similar to FIG. 16, illustrating the relationship between the motor and biasing assembly when the rocker bar is in the operating position shown in FIG. 17.

After a camshaft 34 has been mounted on the headstock 72 and tailstock 74 in the manner shown in FIG. 5, the valve assembly 326 is actuated from the initial or loading position of FIG. 16 to the operating position of FIG. 18. This ports high pressure fluid to the lower variable volume chamber 314 through the conduit 344. In addition, actuation of the valve assembly 326 to the operating position of FIG. 18 connects the upper variable volume chambers 316 and 318 with drain or reservoir 342 through the conduits 332, 338 and 340.

The relatively high pressure against the rod end of the piston 320 moves the piston upwardly from the retracted position of FIG. 16. As this occurs, the biasing assembly 108 pulls the arm 106 upwardly from the position shown in FIG. 15 to the position shown in FIG. 17. This pivots the rocker bar 68 about the axis 90 from the loading or fully retracted position (FIG. 15) to an operating position in a range of operating positions (FIG. 17). During movement of the rocker bar 68 from the loading position of FIG. 15 to the operating position of FIG. 17, the springs in the biasing assembly 108 are effective to hold the rollers 348 and 350 (FIG. 16) on the rocker bar arm 106 against the bottom of the bracket 274.

When the rocker bar 68 reaches the operating position shown in FIG. 17, the master cam assembly 112 (FIGS. 5 and 8) will have moved into engagement with the cam follower 110. The abutting engagement between the cam follower 110 and a selected one of the cam elements 118 the master cam assembly 112 will hold the rocker bar 68 against movement from the operating position shown in FIG. 17 during further operation of the motor 104. Of course, as the master cam assembly 112 and camshaft 34 are later rotated together, the interaction between master cam assembly and the cam follower 110 will cause the rocker bar 68 to pivot toward and away from the grinding wheel 48 through a range of operating positions. The extent of the range of operating positions through which the rocker bar 68 is moved by the interaction between the master cam 112 and cam follower 110 is determined by the desired configuration of the cam lobes 32.

As the piston 320 moves from the loading position of FIG. 16 toward the actuated position of FIG. 18 to pivot the rocker bar 68 from its loading position (FIG. 15) to an operating position (FIG. 17), the master cam assembly 112 moves into engagement with the cam follower 110. In accordance with a feature of the invention, the operating speed of the motor 104 is reduced shortly before the master cam assembly 112 engages the follower 110. This tends to minimize the load applied to the master cam 112 and cam follower 110 as they are moved into abutting engagement.

Accordingly, as the piston 320 moves upwardly from the position shown in FIG. 16 toward the position shown in FIG. 18, the piston closes off a port 360 in the sidewall of the housing 310. After this happens, fluid is conducted to drain 342 from the variable volume chamber 316 through only the upper port 362 in the wall of the housing 310. An orifice 366 in the flow control valve 326 limits the rate at which fluid can be exhausted from the variable volume chamber 316 through the port 362 to reduce the operating speed of the motor 104.

The lower port 360 is freely connected with drain through a passage 368 in the flow control valve 326. Therefore, before the piston 320 closes off the lower port 360 to the variable volume chamber 316, fluid can be freely exhausted from the variable volume chamber through both of the ports 360 and 362. Immediately before the rocker bar 68 reaches the range of operating positions and before the master cam assembly 112 moves into engagement with the cam follower 110, an upper end face 372 of the piston 320 moves past the port 360 to block fluid flow from the variable volume chamber 312 through the conduit 340. Therefore, fluid can only flow from the variable volume chamber 316 through the port 362 and the restricted passage 366 in the flow control valve 326. This results in a reduction in the operating speed of the motor 104.

It should be understood that the exact operating position to which the rocker bar 68 is moved will depend upon the angular orientation of the cam element 118 which engages the cam follower 110 as the rocker bar 68 moves into the range of operating positions. The operating position shown in FIG. 17 for the rocker bar should be considered as merely being representative of one particular operating position in the range of operating positions through which the rocker bar is movable. Of course, during rotation of the camshaft 34 and master cam assembly 112, the rocker bar 68 will be moved through the range of operating positions as the cam lobes 32 are ground.

After the rocker bar 68 has been moved to an operating position (FIG. 17), continued operation of the motor 104 actuates the biasing assembly 108. Since the first operation which is performed on a cam lobe 32 is a rough grinding operation in which material is removed at a relatively high rate from the cam lobe, the motor 104 actuates the biasing assembly 108 to resiliently deflect the springs 244–254 to a relatively large extent. This results in the application of a relatively large biasing force against the arm 106 urging the cam lobes 32 toward the grinding wheel 48 and pressing the master cam 112 firmly against the cam follower 110.

Figure 19:
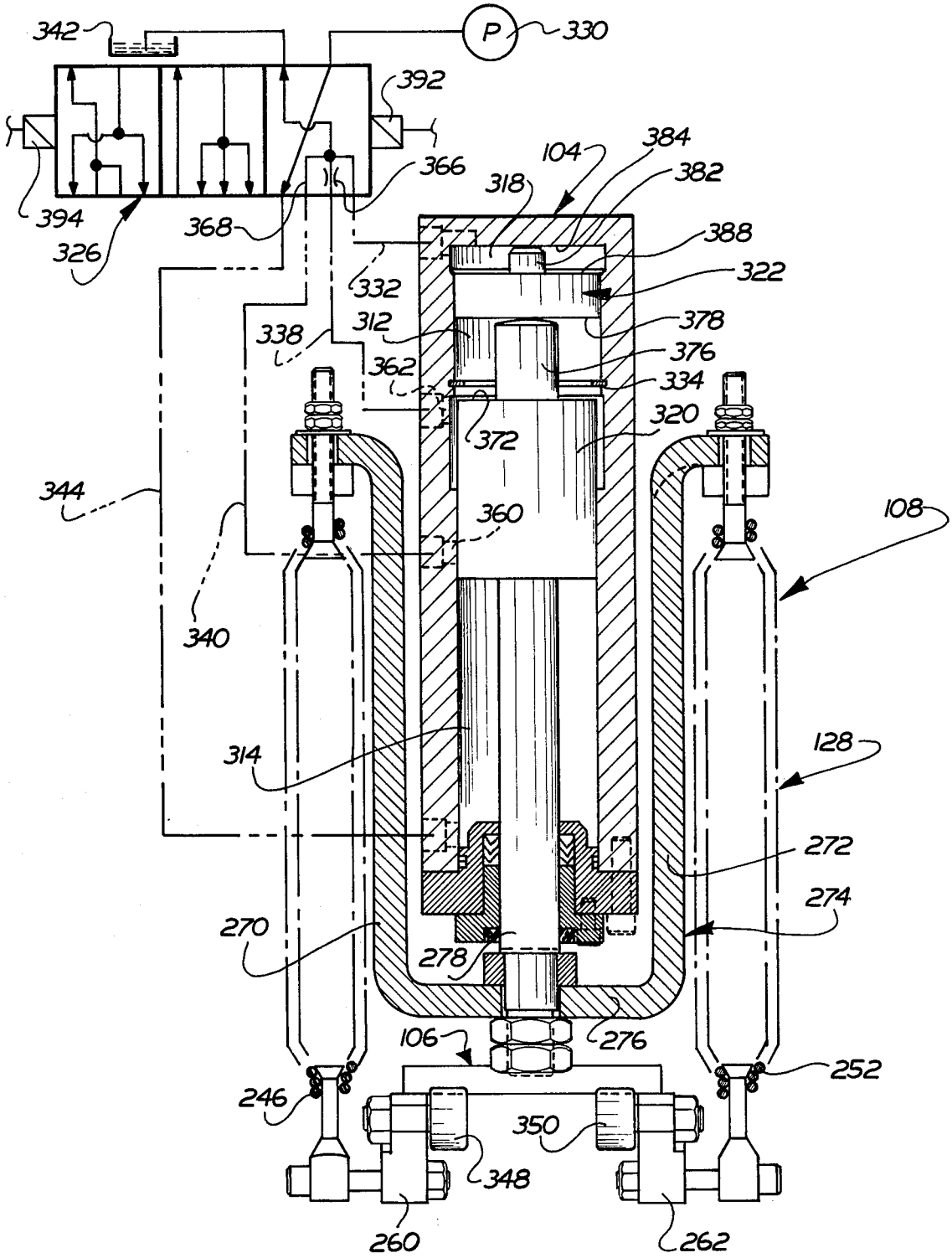
FIG. 19 is a sectional view, generally similar to FIG. 18, illustrating the relationship between the motor and the biasing assembly when the rocker bar is in an operating position and the biasing assembly is effective to apply a relatively large force to the rocker bar urging the camshaft toward the grinding wheel during a rough grinding operation.

In order to actuate the biasing assembly 108, the piston 320 in the motor 104 continues to move upwardly from the position shown in FIG. 18 toward the rough grinding position shown in FIG. 19. This upward movement of the piston 320 moves an outwardly projecting cylindrical end section 376 on the piston 320 into abutting engagement with a circular bottom surface 378 on the auxiliary piston 322. Continued upward movement of the piston 320 moves the coaxial auxiliary piston 322 upwardly from the initial position shown in FIG. 18 to the rough grinding position shown in FIG. 19. When the two pistons 320 and 322 reach the rough grinding position of FIG. 19, a cylindrical end section 382 on the auxiliary piston is disposed in abutting engagement with an end surface 384 on the housing 310.

When the motor 104 is in the rough grinding condition shown in FIG. 19, the bracket 274 has moved upwardly from the rollers 348, 350 on the sections 360 and 362 of the arm 106 which extends outwardly from the rocker bar 68. The bracket 274 moves upwardly and stretches the springs 244–254 in the biasing assembly 108 because of the abutting engagement between the master cam assembly 112 and the cam follower 110. The abutting engagement prevents further movement of the rocker bar from the operating position shown in FIG. 17 as the piston 320 moves upwardly.

When the motor 104 and biasing assembly 108 are in the rough grinding condition of FIG. 19, the springs 244–254 in the biasing assembly 108 are resiliently stretched or deflected to apply a biasing force to the rocker arm 68. This biasing force urges the rocker arm 68 in a clockwise direction as viewed in FIG. 17. The rocker arm biasing force urges the camshaft 34 toward the grinding wheel 48 with a sufficient force to overcome the relatively large forces which are present during a rough grinding operation. The rocker arm biasing force also tends to prevent separation between the master cam 112 and cam follower 110. Therefore throughout the rough grinding operation, the motor 104 remains in the condition shown in FIG. 19 in which the biasing assembly 108 is effective to apply a relatively large biasing force to the rocker arm 68. As the master cam assembly 112 is rotated with the camshaft 34 during the rough grinding of a cam lobe 32, the cam element 118 of the master cam which is engaged by the cam follower 110 causes the rocker bar 68 to pivot back and forth about the axis 90 toward and away from the grinding wheel 48. This movement of the rocker bar 68 through a range of operating positions results in a slight variation in the extent to which the springs 244–254 in the biasing assembly 108 are deflected. However, even when the base circle portion of master cam element 118 is in engagement with the cam follower 110 so that the biasing assembly 108 is deflected to a minimum extent during rough grinding operation, the force applied by the biasing assembly to the rocker bar 68 is sufficient to urge the master cam assembly 112 firmly toward the cam follower 110 and to overcome the operating forces between the cam lobe 32 and grinding wheel 48.

During a finish grinding operation, material is removed at a lower rate from the cam lobe 32 by the grinding wheel 48. Therefore, the biasing assembly 108 does not have to overcome the relatively large operating forces which are present during a rough grinding operation. This allows the force with which the biasing assembly 108 urges the rocker bar 68 toward the grinding wheel 48 to be reduced with a resulting reduction of force with which the master cam assembly 112 is urged toward the cam follower 110.

Reducing the forces between the master cam assembly 112 and cam follower 110 is effective to reduce the amount to which the components of the grinding machine 30 are deflected. This increase the accuracy with which the rocker bar 68 is moved relative to the grinding wheel 48. Of course, this increases the accuracy with which the finish grinding operation is performed.

Figure 20:
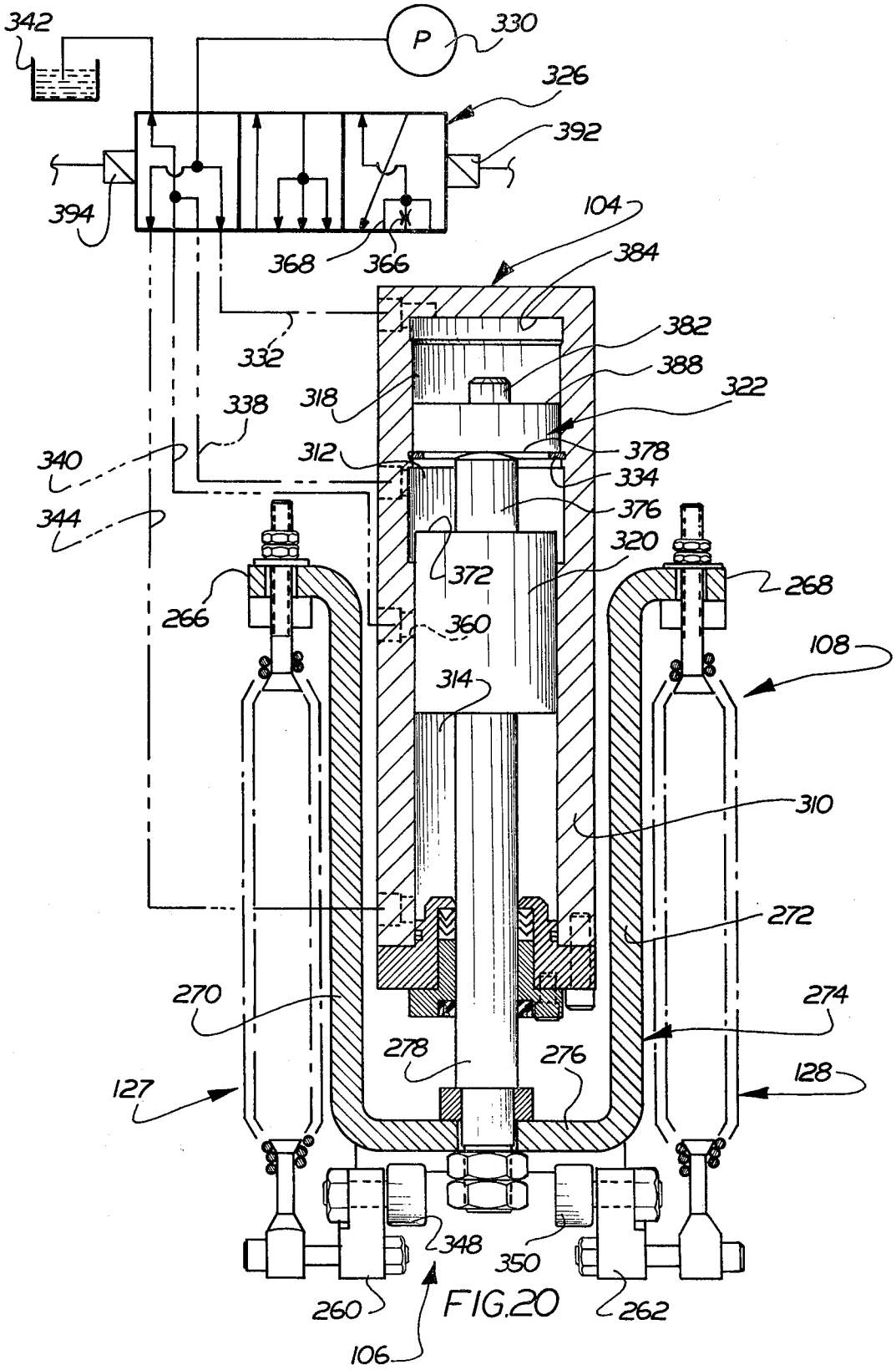
FIG. 20 is a sectional view, generally similar to FIG. 19, illustrating the relationship between the motor and biasing assembly when the biasing assembly is effective to apply a relatively small force to the rocker bar urging the camshaft toward the grinding wheel during a finish grinding operation.

In order to reduce the force with which the biasing assembly 108 urges the rocker bar 68 toward the grinding wheel 48 during a finish grinding operation, the motor 104 is operated from the condition shown in FIG. 19 to the condition shown in FIG. 20 before the finish grinding operation is undertaken. To accomplish this, the flow control valve 326 is operated to port fluid pressure to both the upper variable volume chamber 318 and the lower variable volume chamber 314 (FIG. 20). The secondary piston 322 has a circular upper face 388 with a larger surface area than the upper face 372 of the piston 320. Therefore, even though the fluid pressure in the upper variable volume chamber 318 is the same as the fluid pressure in the lower variable volume chamber 314, the fluid pressure against the piston 322 is effective to force the main piston 320 downwardly from the position shown in FIG. 19 to the position shown in FIG. 20.

The movement of the auxiliary piston 322 under the influence of fluid pressure in the variable volume chamber 318 is stopped when the piston 322 engages the annular ring 334. At this time the bracket 174 is spaced from the rollers 348 and 350 on the sections 260 and 262 of the arm 106 which extends outwardly from the rocker bar 68 (see FIG. 15). However, the spacing between the rollers 348 and 350 and the bracket 174 is not as great as when the motor 104 is in the condition shown in FIG. 19 for a rough grinding operation. Therefore, when the motor 104 has been operated to the condition shown in FIG. 20 prior to initiation of a finish grinding operation, the extent to which the springs 244–254 are stretched is reduced. Therefore, the biasing assembly 108 is effective to apply a reduced force to the rocker bar 68.

The reduced rocker bar biasing force is sufficient to maintain the master cam assembly 112 in abutting engagement with the cam follower 110 during the finish grinding operation. In addition the reduced biasing force is sufficient to overcome the relatively small operating forces between the cam lobes 32 and the grinding wheel 48 during the removal of material from the cam lobes during a finish grinding operation.

After the finish grinding operation on a cam lobe has been completed, the motor assembly 104 is operated to move the rocker bar toward the loading position of FIG. 15. Thus, the flow control valve 326 is actuated from the condition shown in FIG. 20 back to the condition shown in FIG. 16. This results in fluid pressure being ported to the variable volume chamber 316 and the variable volume chamber 314 being connected with drain to enable the piston 320 to move downwardly to pivot the rocker bar 68 toward the loading position.

Although the flow control valve 326 could be operated in many different ways, the control valve is advantageously operated by the computer 146 (see FIG. 4). The computer 146 effects energization of a solenoid 392 to effect operation of the flow control valve 326 from the initial or loading condition of FIG. 16 to the actuated condition for a rough grinding operation shown in FIG. 19. A solenoid 394 is energized to effect operation of the flow control valve to the finish grinding position shown in FIG. 20. If both solenoids 392 and 394 are de-energized, return springs move the flow control valve back to the initial condition shown in FIG. 16.

It should be noted that the biasing springs 244–254 and motor 104 are disposed to one side of the rocker bar 68 (see FIG. 8). This provides easy access to the master cam assembly 112 through a releasable cover across the upper end of the housing 176. When the master cam assembly 112 is in the loading position shown in FIG. 8, the master cam assembly can be easily replaced by another master cam assembly to enable the grinding machine 30 to grind a different camshaft.

Index Position

As the grinding of each of the cam lobes 32 is completed, the camshaft 34 and grinding wheel 48 are separated. This enables the work table or carriage 44 to be moved relative to the base 38 to position the next succeeding cam lobe adjacent to the grinding wheel 48. Since the angular orientation and/or configuration of the next succeeding cam lobe 32 is different than the angular orientation and/or configuration of the preceding cam lobe, it is necessary to have the cam follower 110 (FIG. 5) in engagement with a different cam element 118 in the master cam 112.

In order to change the cam element 118 engaged by the cam follower 110, the master cam assembly 112 must be disengaged from the cam follower. This is accomplished by operating the motor 104 to pivot the rocker bar 68 toward the loading position. However, it is not necessary to move the rocker bar 68 and cam 34 all the way to the fully retracted or loading position. It is merely necessary to separate the master cam 112 assembly from the cam follower 110 by a distance sufficient to prevent interference between the cam follower and cam elements 118 as the cam follower is moved axially along the master cam 112 by operation of the motor 122.

Therefore, the rocker bar motor 104 is only operated to an extent which is sufficient to pivot the rocker bar 68 to an index position. The index position of the rocker bar 68 is disposed between the range of operating positions and the fully retracted or loading position. It should be noted that the index position of the rocker bar 68 must be disposed slightly to one side of the range of operating positions through which the rocker bar is oscillated by the interaction between the cam follower 110 and master cam 112. This is necessary in order to be certain that there will be no interference between cam follower 110 and master cam assembly 112 as the cam follower is indexed axially relative to the master cam.

Figure 22:
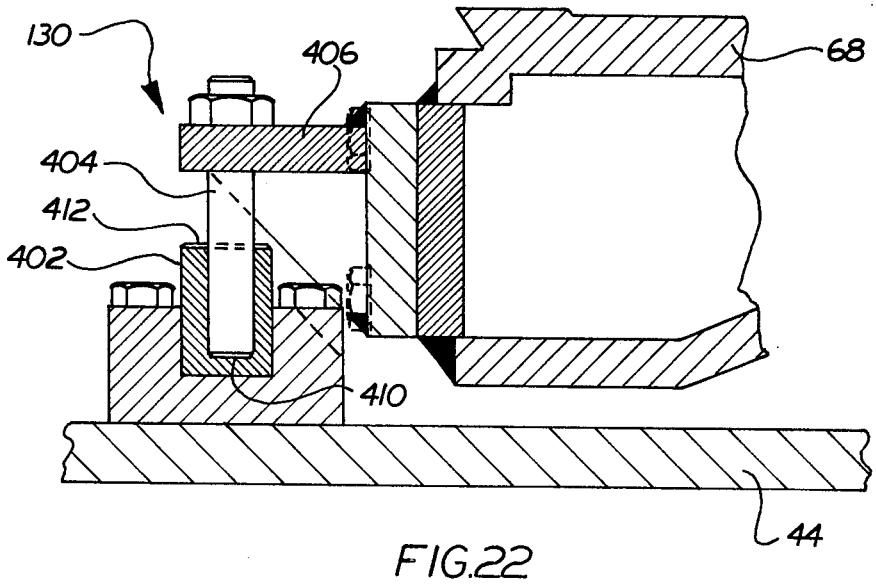
FIG. 22 (on sheet 13 of the drawings) is a fragmentary sectional view, taken generally along the line 22—22 of FIG. 21, further illustrating the relationship between the stop assembly and the rocker bar.
Figure 21:
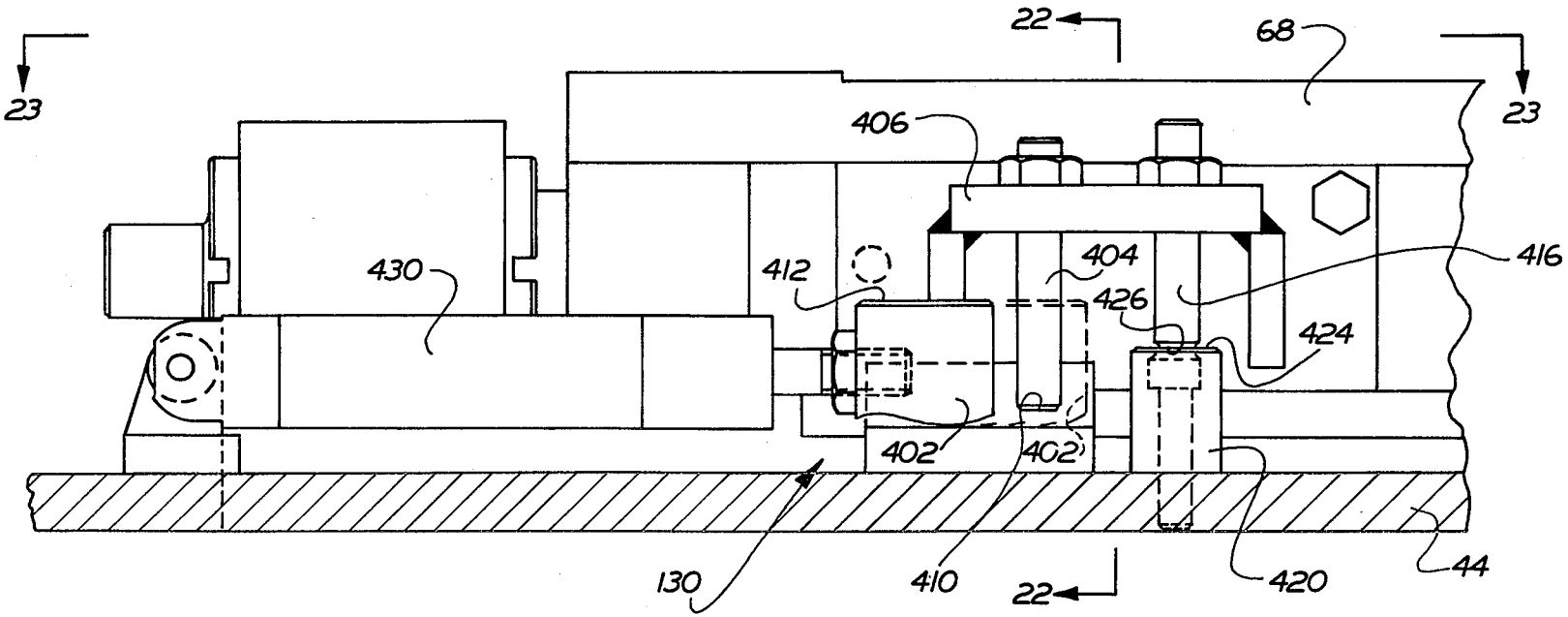
FIG. 21 is an elevational view illustrating the relationship between a stop assembly and the rocker bar, the rocker bar being shown in a fully retracted or loading position.
Figure 23:
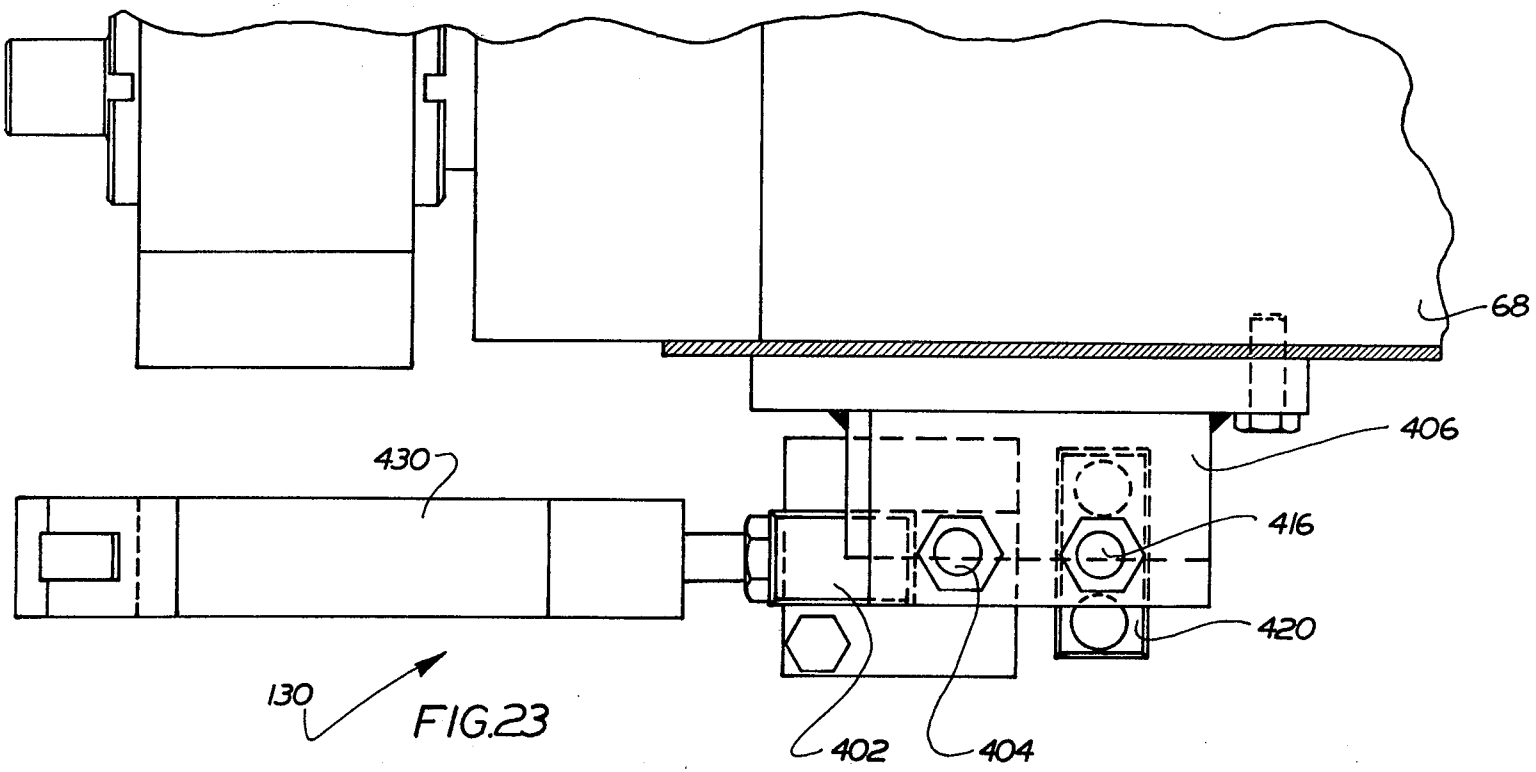
FIG. 23 is a plan view, taken generally along the line 23—23 of FIG. 21, further illustrating the relationship between the stop assembly and the rocker bar.

In order to prevent movement of the rocker bar 68 past the index position to the fully retracted or loading position, the stop assembly 130 (see FIGS. 5 and 21–23) is actuated when the rocker bar 68 is in an operating position. Actuation of the stop assembly 130 moves a stop block 402 (FIGS. 21, 22 and 23) into alignment with a stop pin 404 which is connected with a flange 406 which extends outwardly from the rocker bar 68. Engagement of a stop surface 410 (FIG. 21) at one end of the stop pin 404 with a stop surface 412 on the block 402 is effective to prevent movement of the rocker bar 68 from an operating position to the fully retracted or loading position. Thus, engagement of the stop surface 410 on the stop pin 404 with the stop surface 412 on the block 402 stops movement of the rocker bar when it is in an index position which is intermediate the range of operating positions and fully retracted or loading position.

Whenever the grinding of a camshaft is completed, the stop block 402 is moved out of alignment with the stop pin 404 to enable a stop pin 416 (see FIG. 21) to move into engagement with a stop member 420 which is connected with the carriage 44. The stop member 420 has an upper stop surface 424 which is disposed below or closer to the carriage 44 than the stop surface 412 on the stop block 402. Therefore, a stop surface 426 on the lower end of the pin 416 engages the stop surface 424 on the member 420 when the rocker bar 68 has been moved past the index position to the retracted or loading position.

The stop block 402 is moved between an unactuated or inactive condition (shown in solid lines in FIG. 21) and an actuated or active condition (shown in dashed lines in FIG. 21) by a piston and cylinder type motor 430. Thus, when the rocker bar 68 is in an operating position and both of the stop pins 404 and 416 have been pivoted upwardly from the position shown in FIG. 21, the motor 430 is operated. This moves the stop block 402 from the inactive position to the active position in alignment with the end surface 410 of the stop pin 404. Therefore, upon subsequent operation of the motor 104 to pivot the rocker bar 68 back toward the retracted or loading position, the end of the pin 410 engages the stop surface 412. This interrupts motion of the rocker bar 68 before it has been moved all the way to the loading position. By moving the rocker bar 68 to only the indexing position which is short of the fully retracted position, the time required to grind a camshaft is reduced.

SUMMARY

In view of the foregoing description it is apparent that the present invention provides a camshaft grinding machine 30 and method which improves the accuracy with which cam lobes 32 can be ground, facilitates the setting up of the grinding machine to grind different camshafts 34, and increases the speed with which camshafts can be ground. In order to increase the accuracy with which cam lobes 32 can be ground, the biasing force with which a camshaft 34 is urged toward the grinding wheel 48 is reduced during a finish grinding operation. By reducing the biasing force urging the camshaft toward the grinding wheel 48, the force on a master cam assembly 112 is reduced with a resulting reduction in the deflection of the various components of the grinding machine. In addition, inaccuracies due to wear of the master cam assembly 112 and/or follower 110 are reduced by reducing the speed at which the master cam assembly and follower are moved into abutting engagement without unduly slowing the operating speed of the grinding machine.

In order to facilitate setting up and operating the grinding machine, the necessity of providing dogs to actuate a drive mechanism which moves a follower relative to a master cam assembly has been eliminated. In a grinding machine 30 constructed in accordance with another feature of the present invention, the cam follower 110 is moved independently of movement of a carriage or work table 44 relative to a base 38 of the machine. This is accomplished by providing a separate motor 122 which is disposed on the carriage 44 adjacent to the cam follower 110. A signal generator 208 is associated with the cam follower motor 122 to provide an output signal which can be utilized by control circuitry 220 to determine the position of the cam follower relative to the master cam assembly.

In accordance with still another feature of the present invention, the speed of operation of the grinding machine 30 is increased by reducing the extent of movement of the rocker bar 68 between cam lobe grinding operations. Thus, when a first cam lobe 32 has been ground, the rocker bar 68 is moved from an operating position (FIG. 17) to an index position which is closer to the operating position than is the loading position (FIG. 15). However, the distance which the rocker bar 68 moves from the operating position to the index position is sufficient to separate the master cam assembly 112 and cam follower 110 so that the cam follower can be freely moved relative to the master cam assembly.

Having described one specific preferred embodiment of the invention, the following is claimed:

1. A grinding machine for use in grinding a cam lobe on a camshaft, said grinding machine comprising rotatable grinding wheel means for removing material from the cam lobe at a first rate during a rough grinding operation and for removing material from the cam lobe at a second rate which is less than the first rate during a finish grinding operation, workpiece support means for supporting the camshaft during the rough and finish grinding operations, said workpiece support means being movable toward and away from said grinding wheel means between a retracted position in which the cam lobe is spaced from said grinding wheel means, an operating position in which the cam lobe is engageable by said grinding wheel means and an index position which is disposed intermediate said operating and retracted positions, motor means for moving said workpiece support means between the retracted, operating and index positions, biasing means connected with said workpiece support means for urging said workpiece support means toward said grinding wheel means with a first force during a rough grinding operation and for urging said workpiece support means toward said grinding wheel means with a second force which is less than the first force during a finish grinding operation, control means connected with said workpiece support means for use in effecting movement of said workpiece support means toward and away from said grinding wheel means as a function of the desired configuration of the cam lobe, said control means including a master cam element having a configuration which is a function of the desired configuration for the cam lobe and a cam follower element, said biasing means being effective to urge said master cam element and cam follower element toward a condition of abutting engagement with the first force during a rough grinding operation and with the second force during a finish grinding operation, one of said master cam and cam follower elements being connected with said workpiece support means for movement therewith relative to the other of said master cam and cam follower elements, said one of said master cam and cam follower elements being spaced from the other of said master cam and cam follower elements by a first distance when said workpiece support means is in the retracted position, being spaced from the other of said master cam and cam follower elements by a second distance which is less than said first distance when said workpiece support means is in the index position and being disposed in abutting engagement with the other of said master cam and cam follower elements when said workpiece support means is in the operating position.

2. A grinding machine as set forth in claim 1 further including means for moving said cam follower element relative to said master cam element when said workpiece positioning means is in the retracted position and when said workpiece positioning means is in the index position.

3. A grinding machine as set forth in claim 2 further including selectively actuatable stop means for limiting movement of said workpiece positioning means to movement between the index and operating positions.

4. A grinding machine as set forth in claim 1 further including speed regulator means for reducing the speed of operation of said motor means in response to movement of said workpiece support means to a position adjacent to the operating position during movement of said workpiece support means from the retracted position to the operating position.

5. A grinding machine for use in grinding a cam lobe on a camshaft, said grinding machine comprising rotatable grinding wheel means for removing material from the cam lobe at a first rate during a rough grinding operation and for removing material from the cam lobe at a second rate which is less than the first rate during a finish grinding operation, workpiece support means for supporting the camshaft during the rough and finish grinding operations, and biasing means connected with said workpiece support means for urging said workpiece support means toward said grinding wheel means with a first force during a rough grinding operation and for urging said workpiece support means toward said grinding wheel means with a second force which is less than the first force during a finish grinding operation, said biasing means including a plurality of springs which are resiliently deflectable to a first extent to provide the first force and are resiliently deflectable to a second extent which is less than the first extent to provide the second force, motor means for deflecting said plurality of springs, said motor means including first and second pistons, and control means for effecting the application of fluid pressure against said first piston to effect deflection of said plurality of springs to the first extent and for effecting the application of fluid pressure against said second piston to effect deflection of said plurality of springs to the second extent.

6. A grinding machine as set forth in claim 5 further including control means connected with said workpiece support means for use in effecting movement of said workpiece support means toward and away from said grinding wheel means as a function of the desired configuration of the cam lobe, said control means including a master cam element having a configuration which is a function of the desired configuration for the cam lobe and a cam follower element, said plurality of springs being effective to urge said master cam element and cam follower element toward a condition of abutting engagement with the first force during a rough grinding operation and with the second force during a finish grinding operation.

7. A grinding machine as set forth in claim 5 wherein said workpiece support means is movable toward and away from said grinding wheel means between a retracted position in which the cam lobe is spaced from said grinding wheel means, an operating position in which the cam lobe is engageable by said grinding wheel means during rough and finish grinding operations and an index position which is disposed intermediate said operating and retracted positions, said motor means being operable to effect movement of said workpiece support means between the retracted, operating and index positions.

8. A grinding machine as set forth in claim 7 further including selectively adjustable stop means operable between a first condition in which said stop means blocks movement of said workpiece support means from the index position to the retracted position and a second condition in which said stop means is ineffective to block movement of said workpiece support means to the retracted position.

9. A grinding machine as set forth in claim 7 further including speed regulator means for reducing the speed operation of said motor means in upon movement of said workpiece support means to a position adjacent to the operating position.

10. A grinding machine as set forth in claim 5 wherein said motor means includes a housing, said first and second pistons being disposed in axial alignment with each other in said housing being movable relative to each other, said first piston being movable from a position spaced from said second piston to a position disposed in engagement with said second piston during deflection of said springs under the influence of fluid pressure applied against said first piston and deflection of said springs to the first extent, said second piston being effective to move said first piston relative to said housing under the influence of fluid pressure applied against said second piston.

11. A grinding machine for use in grinding a plurality of cam lobes on a longitudinally extending camshaft, said grinding machine comprising a base, a movable carriage connected with said base, first drive means for moving said carriage relative to said base, movable workpiece support means for supporting a camshaft, said workpiece support means including an elongated rocker bar connected with said carriage for movement therewith along a path extending parallel to the longitudinal axes of said rocker bar and the camshaft supported by said support means, means for supporting said rocker bar for pivotal movement relative to said carriage about a pivot axis extending parallel to the longitudinal axis of said rocker bar, headstock means movable with said rocker bar relative to said carriage for engaging one end portion of the camshaft and rotating the camshaft about its longitudinal axis, tailstock means movable with said rocker bar relative to said carriage for engaging another end portion of the camshaft, grinding wheel means for grinding the lobes on the camshaft supported by said workpiece support means, and control means for use in effecting pivotal movement of said rocker bar toward and away from said grinding wheel means as a function of the desired configurations of the cam lobes on the camshaft supported by said workpiece support means, said control means including a plurality of master cams having configurations which are a function of the desired configurations of the lobes on the camshaft supported by said workpiece support means, said master cams being mounted on said rocker bar for pivotal movement therewith, a cam follower, means for supporting said cam follower on said carriage for movement relative to said rocker bar along a path extending parallel to the longitudinal axis of said rocker bar, said cam follower being movable to selectively engage each of said master cams, and second drive means for moving said cam follower from a first position engaging a first one of said master cams to a second position engaging a second one of said master cams independently of operation of said first drive means and movement of said carriage relative to said base, said second drive means including a cam follower drive motor and means for connecting said cam follower drive motor with said cam follower.

12. A grinding machine as set forth in claim 11 wherein said control means further includes data storage means for storing data indicative of a desired position of said cam follower relative to said master cams, signal generator means for providing signals for determining the actual position of said cam follower relative to said master cams, and means for comparing the desired position of said cam follower with the actual position of said cam follower and for effecting operation of said motor to move said cam follower toward the desired position when the actual position of said cam follower differs from the desired position.

13. A grinding machine as set forth in claim 11 wherein said grinding wheel means is operable to remove material from a cam lobe at a first rate during a rough grinding operation and is operable to remove material from a cam lobe at a second rate which is less than the first rate during a finish grinding operation, said control means including biasing means for urging said cam follower and one of said master cams toward a condition of abutting engagement with a first force during a rough grinding operation and for urging said cam follower and one of said master cams toward a condition of abutting engagement with a second force which is less than the first force during a finish grinding operation.

14. A grinding machine as set forth in claim 11 wherein said control means further includes signal generator means connected with said cam follower drive motor for providing output signals and means for utilizing the output signals from said signal generator means to determine the position of said cam follower.

15. A grinding machine for use in grinding a plurality of cam lobes on a camshaft, said grinding machine comprising a base, a movable carriage connected with said base, means for moving said carriage relative to said base, a longitudinally extending rocker bar connected with said carriage for movement therewith relative to said base, said rocker bar being pivotal relative to said carriage about an axis which extends parallel to the longitudinal central axis of said rocker bar, means for rotatably supporting a camshaft on said rocker bar for rotation about an axis extending parallel to and spaced apart from the axis about which said rocker bar pivots relative to said carriage, means for rotating the camshaft relative to said rocker bar, grinding wheel means for sequentially grinding the lobes on the camshaft while the camshaft is being rotated relative to said rocker bar, and control means for effecting pivotal movement of said rocker bar toward said grinding wheel means from a retracted position through an index position to an operating position in a range of operating positions which are spaced from the index position, for effecting pivotal movement of said rocker bar toward and away from said grinding wheel means in the range of operating positions during the grinding of each of the cam lobes in turn and as a function of the desired configurations of each of the cam lobes and for effecting pivotal movement of said rocker bar from an operating position in the range of operating positions to the index position upon completion of grinding of one of said cam lobes and prior to grinding of a succeeding cam lobe, said control means including master cam means and cam follower means, said master cam means including a plurality of master cam elements having configurations which are a function of the configurations of the cam lobes on the camshaft, said cam follower means and each of said plurality of master cam elements being selectively engageable, means for effecting relative movement between said master cam and cam follower means along a path extending parallel to the axis about which said rocker bar pivots when said rocker bar is in the index position to enable said cam follower means to be aligned with each of said master cam elements in turn, one of said cam follower and master cam means being connected with said rocker bar for movement therewith relative to the other of said cam follower and master cam means, said master cam means and cam follower means being spaced apart by a first distance when said rocker bar is in the retracted position, said master cam means and cam follower means being spaced apart by a second distance which is less than said first distance and which is sufficient to enable said cam elements to clear said cam follower means upon relative movement between said cam follower means and master cam means along the path which extends parallel to the axis about which said rocker bar pivots when said rocker bar is in the index position, said cam follower means being disposed in abutting engagement with a master cam element with which said cam follower means was previously aligned when said rocker bar is in an operating position in the range of operating positions, and motor means for pivoting said rocker bar from the retracted position to an operating position in the range of operating positions, for pivoting said rocker bar from an operating position in the range of operating positions to the index position upon completion of a grinding operation on one cam lobe and prior to grinding of a succeeding cam lobe to enable relative movement to occur between said cam follower and master cam means along the path extending parallel to the axis about which said rocker bar pivots to change the master cam element aligned with said cam follower means, and for pivoting said rocker bar from the index position back to an operating position in the range of operating positions after the master cam element aligned with said cam follower means has been changed.

16. A grinding machine as set forth in claim 15 wherein said control means further includes first and second stop surfaces connected with said carriage and third and fourth stop surfaces connected with said rocker bar for movement therewith relative to said carriage, said first and third stop surfaces being disposed in abutting engagement when said rocker bar is in the retracted position, said second and fourth stop surfaces being disposed in abutting engagement when said rocker bar is in the index position.

17. A grinding machine as set forth in claim 16 further including motor means for moving said second stop surface between a first position offset from said fourth stop surface and a second position aligned with said fourth stop surface.

18. A grinding machine as set forth in claim 15 wherein said means for effecting relative movement between master cam means and cam follower means includes an index motor and drive means for transmitting force from said index motor to said cam follower means to effect movement of said cam follower means relative to said master cam means along the path extending parallel to the axis about which said rocker bar pivots.

19. A grinding machine as set forth in claim 15 wherein said means for effecting relative movement between said master cam means and cam follower means includes means for moving said cam follower means relative to said master cam means along a path extending parallel to the axis about which said rocker bar pivots independently of movement of said carriage relative to said base.

20. A grinding machine as set forth in claim 15 wherein said control means further includes biasing means connected with said rocker bar for urging said rocker bar toward said grinding wheel means with a first force during a first portion of a grinding operation on a cam lobe and for urging said rocker bar toward said grinding wheel means with a second force which is smaller than the first force during a second portion of a grinding operation on a cam lobe.

21. A grinding machine as set forth in claim 15 wherein said control means further includes means for urging one of said master cam elements in said master cam means and said cam follower means into abutting engagement with a first force during a portion of a grinding operation on a cam lobe and for urging said one of said master cam elements and said cam follower means into abutting engagement with a second force which is smaller than the first force during another portion of a grinding operation on a cam lobe.

22. A grinding machine as set forth in claim 15 wherein said control means further includes means for effecting operation of said grinding wheel means to remove material from a cam lobe at a first rate during a rough grinding operation and for effecting operation of said grinding wheel means to remove material from a cam lobe at a second rate during a finish grinding operation, and biasing means connected with said rocker bar for urging a cam lobe toward said grinding wheel means with a first force during a rough grinding operation and for urging a cam lobe toward said grinding wheel means with a second force which is less than the first force during a finish grinding operation.

23. A grinding machine as set forth in claim 22 wherein said biasing means is effective to urge said cam follower and master cam means toward a condition of abutting engagement with the first force during a rough grinding operation and with the second force during the finish grinding operation.

24. A grinding machine as set forth in claim 15 wherein said control means further includes speed regulator means for reducing the speed of operation of said motor means in response to movement of said rocker bar to a position adjacent to and spaced from the range of operating positions during pivotal movement of said rocker bar from the retracted position to an operating position.

25. A grinding machine for use in grinding a plurality of cam lobes on a camshaft, said grinding machine comprising a base, a movable carriage connected with said base, means for moving said carriage relative to said base, a longitudinally extending rocker bar connected with said carriage for movement therewith relative to said base, said rocker bar being pivotal relative to said carriage about an axis which extends parallel to the longitudinal central axis of said rocker bar, means for rotatably supporting a camshaft on said rocker bar for rotation about an axis extending parallel to and spaced apart from the axis about which said rocker bar pivots relative to said carriage, means for rotating the camshaft relative to said rocker bar, grinding wheel means for sequentially removing material from each of the cam lobes in turn at a first rate during a rough grinding operation and for sequentially removing material from each of the cam lobes in turn at a second rate during a finish grinding operation, and control means for effecting pivotal movement of said rocker bar toward said grinding wheel means from a retracted position to an operating position in a range of operating positions, for effecting pivotal movement of said rocker bar toward and away from said grinding wheel means in the range of operating positions during the rough and finish grinding of each of the cam lobes in turn and as a function of the desired configurations of each of the cam lobes, for applying a first force to said rocker bar urging said rocker bar toward said grinding wheel means during the rough grinding operation and while said rocker bar is moving in the range of operating positions, and for applying a second force to said rocker bar urging said rocker bar toward said grinding wheel means during the finish grinding operation and while said rocker bar is moving in the range of operating positions, said second force being less than said first force, said control means including biasing means operable from a first condition to a second condition to apply the first force to said rocker bar and operable from the second condition to a third condition to apply the second force to said rocker bar, and motor means for pivoting said rocker bar from the retracted position to the range of operating positions, for operating said biasing means from the first condition to the second condition prior to initiation of a rough grinding operation on a workpiece and for operating said biasing means from the second condition to the third condition prior to initiation of a finish grinding operation on a workpiece, said motor means including a housing defining a chamber and a plurality of pistons disposed in said chamber and dividing said chamber into a plurality of variable volume chamber sections, said control means further including valve means for directing fluid pressure to a first one of said variable volume chamber sections to move a first one of said plurality of pistons to increase the volume of the first one of said variable volume chambers and pivot said rocker bar from said retracted position to an operating position in the range of operating positions and to effect operation of said biasing means from the first condition to the second condition, for directing fluid pressure to a second one of said variable volume chamber sections to move a second one of said plurality of pistons to increase the volume of a second one of the variable volume chambers to effect operation of said biasing means from the second condition to the third condition.

26. A grinding machine for use in grinding a plurality of cam lobes on a camshaft, said grinding machine comprising a base, a movable carriage connected with said base, means for moving said carriage relative to said base, a longitudinally extending rocker bar connected with said carriage for movement therewith relative to said base, said rocker bar being pivotal relative to said carriage about an axis which extends parallel to the longitudinal central axis of said rocker bar, means for rotatably supporting a camshaft on said rocker bar for rotation about an axis extending parallel to and spaced apart from the axis about which said rocker bar pivots relative to said carriage, means for rotating the camshaft relative to said rocker bar, grinding wheel means for sequentially grinding the lobes on the camshaft while the camshaft is being rotated relative to said rocker bar, control means for effecting pivotal movement of said rocker bar toward said grinding wheel means from a retracted position to an operating position in a range of operating positions and for effecting pivotal movement of said rocker bar toward and away from said grinding wheel means in the range of operating positions during the grinding of each of the cam lobes in turn and as a function of the desired configurations of each of the cam lobes, said control means including master cam means and cam follower means, said master cam means including a plurality of master cam elements disposed in a linear array on said rocker bar for movement therewith relative to said cam follower, each of said master cam elements having a configuration which is a function of the configuration of a cam lobe on the camshaft, said cam follower means being disposed on a first side of the linear array of master cam elements outwardly of a first vertical plane extending tangentially to a first edge portion of the linear array of cam elements when said rocker bar is in the retracted position, said cam follower means being engageable with a selected one of said plurality of master cam elements when said rocker bar is in an operating position, means for effecting movement of said cam follower means along a path extending parallel to the axis about which said rocker bar pivots to enable said cam follower means to be aligned with each of said master cam elements in turn, motor means for pivoting said rocker bar relative to said carriage between the retracted position and one of the operating positions, biasing means connected with said rocker bar and said motor means for urging said rocker bar to pivot toward said grinding wheel means when said rocker bar is in one of said operating positions, said motor means and said biasing means being disposed on a second side of the linear array of master cam elements outwardly of a second vertical plane extending tangentially of a second edge portion of the linear array of cam elements opposite from the first edge portion of the linear array of cam elements, and housing means for at least partially enclosing said control means and said biasing means, said housing means including a removable side section which extends through said first and second vertical planes and which is disposed above said linear array of master cam elements with the space between said linear array of master cam elements and said removable side section free of obstructions to provide access to said linear array of master cam elements upon removal of said side section.

27. A grinding machine as set forth in claim 26 wherein said biasing means includes a first plurality of longitudinally extending coil springs disposed adjacent to a first side of said motor means and a second plurality of longitudinally extending coil springs disposed adjacent to a second side of said motor means, said coil springs having longitudinal axes which extend generally parallel to said first and second vertical planes when said rocker bar is in the retracted position.

28. An apparatus as set forth in claim 26 wherein said motor means includes a piston and cylinder assembly which are extendable and retractable along a path which extends generally parallel to said first and second vertical planes when said rocker bar is in the retracted position.

29. A grinding machine as set forth in claim 26 further including speed regulator means for reducing the speed of operation of said motor means in response to movement of said rocker bar to a position adjacent to an operating position during movement of said rocker bar from the retracted position to the operating position.

30. A grinding machine for use in grinding a plurality of cam lobes on a camshaft, said grinding machine comprising a base, a movable carriage connected with said base, means for moving said carriage relative to said base, a support member connected with said carriage for movement therewith relative to said base, said support member being pivotal relative to said carriage, means for rotatably supporting a camshaft on said support member for rotation about an axis extending parallel to and spaced apart from an axis about which said support member pivots relative to said carriage, means for rotating the camshaft relative to said support member, grinding wheel means for sequentially removing material from each of the cam lobes in turn, motor means for effecting pivotal movement of said support member toward said grinding wheel means from a retracted position to an operating position in a range of operating positions, and speed regulator means for reducing the speed of operation of said motor means upon movement of said support member to a position adjacent to the operating position during movement of said support member from the retracted position to the operating position.

31. An apparatus as set forth in claim 30 further including master cam means and cam follower means, said master cam means including a plurality of master cam elements having configurations which are a function of the configurations of the cam lobes on the camshaft, said cam follower means and each of said plurality of master cam elements being selectively engageable, means for effecting relative movement between said master cam and cam follower means to enable said cam follower means to be aligned with each of said master cam elements in turn, one of said cam follower and master cam means being connected with said support member for movement therewith relative to the other of said cam follower and master cam means, said master cam means and cam follower means being spaced apart when said support member is in the retracted position, said cam follower means being disposed in abutting engagement with a master cam element with which said cam follower means was previously aligned when said support member is in an operating position in the range of operating positions.

32. A grinding machine as set forth in claim 31 wherein said means for effecting relative movement between said master cam and cam follower means includes a cam follower motor and means connecting said cam follower motor with said cam follower means to move said cam follower means relative to said master cam means upon operation of said cam follower motor.

33. A grinding machine as set forth in claim 31 including biasing means connected with said support member for urging said support member away from the retracted position with a first force during one portion of the grinding of a lobe on the camshaft and for urging said support member away from the retracted position with a second force which is less than the first force during another portion of the grinding of a lobe on the camshaft.

34. A grinding machine for use in grinding a plurality of cam lobes on a camshaft, said grinding machine comprising a base, a movable carriage connected with said base, means for moving said carriage relative to said base, a longitudinally extending rocker bar connected with said carriage for movement therewith relative to said base, said rocker bar being pivotal relative to said carriage about an axis which extends parallel to the longitudinal central axis of said rocker bar, means for rotatably supporting a camshaft on said rocker bar for rotation about an axis extending parallel to and spaced apart from the axis about which said rocker bar pivots relative to said carriage, means for rotating the camshaft relative to said rocker bar, grinding wheel means for sequentially grinding the lobes on the camshaft while the camshaft is being rotated relative to said rocker bar, and control means for effecting pivotal movement of said rocker bar toward said grinding wheel means from a retracted position to an operating position in a range of operating positions and for effecting pivotal movement of said rocker bar toward and away from said grinding wheel means in the range of operating positions during the grinding of each of the cam lobes in turn and as a function of the desired configurations of each of the cam lobes, said control means including master cam means and cam follower means, said master cam means including a plurality of master cam elements having configurations which are a function of the configurations of the cam lobes on the camshaft, said cam follower means and each of said plurality of master cam elements being selectively engageable, means for effecting relative movement between said master cam and cam follower means to enable said cam follower means to be aligned with each of said master cam elements in turn, one of said cam follower and master cam means being connected with said rocker bar for movement therewith relative to the other of said cam follower and master cam means, said master cam means and cam follower means being spaced apart when said rocker bar is in the retracted position, said cam follower means being disposed in abutting engagement with a master cam element with which said cam follower means was previously aligned when said rocker bar is in an operating position in the range of operating positions, motor means for pivoting said rocker bar from the retracted position to an operating position in the range of operating positions, and means for reducing the operating speed of said motor means in response to movement of said rocker bar to a position adjacent to and spaced from the range of operating positions during pivotal movement of said rocker bar from the retracted position to an operating position to thereby reduce the speed of relative movement between said cam follower means and said master cam means prior to engagement of said cam follower means with one of said master cam elements.

35. A grinding machine as set forth in claim 34 wherein said means for effecting relative movement between said master cam and cam follower means includes a cam follower motor which is disposed on said carriage and means connecting said cam follower motor with said cam follower means to move said cam follower means relative to said master cam means upon operation of said cam follower motor.

36. A grinding machine as set forth in claim 34 wherein said control means further includes biasing means connected with said rocker bar for urging said rocker bar away from the retracted position with a first force during one portion of the grinding of a lobe on the camshaft and for urging said rocker bar away from the retracted position with a second force which is less than the first force during another portion of the grinding of a lobe on the camshaft.

37. A grinding machine for use in grinding a plurality of cam lobes on a camshaft, said grinding machine comprising a base, a movable carriage connected with said base, means for moving said carriage relative to said base, a longitudinally extending rocker bar connected with said carriage for movement therewith relative to said base, said rocker bar being pivotal relative to said carriage about an axis which extends parallel to the longitudinal central axis of said rocker bar, means for rotatably supporting a camshaft on said rocker bar for rotation about an axis extending parallel to and spaced apart from the axis about which said rocker bar pivots relative to said carriage, means for rotating the camshaft relative to said rocker bar, grinding wheel means for sequentially grinding the lobes on the camshaft while the camshaft is being rotated relative to said rocker bar; and control means for effecting pivotal movement of said rocker bar toward said grinding wheel means from a retracted position to an operating position in a range of operating positions, for effecting pivotal movement of said rocker bar toward and away from said grinding wheel means in the range of operating positions during the grinding of each of the cam lobes in turn and as a function of the desired configurations of each of the cam lobes and for effecting pivotal movement of said rocker bar from an operating position in the range of operating positions upon completion of grinding of one of said cam lobes and prior to grinding of a succeeding cam lobe, said control means including master cam means and cam follower means, said master cam means including a plurality of master cam elements having configurations which are a function of the configurations of the cam lobes on the camshaft, said cam follower means and each of said plurality of master cam elements being selectively engageable, drive means for effecting relative movement between said master cam and cam follower means independently of movement of said carriage relative to said base and along a path extending parallel to the axis about which said rocker bar pivots to enable said cam follower means to be aligned with each of said master cam elements in turn, one of said cam follower and master cam means being connected with said rocker bar for movement therewith relative to the other of said cam follower and master cam means, said master cam means and cam follower means being spaced apart when said rocker bar is in the retracted position, said cam follower means being disposed in abutting engagement with a master cam element with which said cam follower means was previously aligned when said rocker bar is in an operating position in the range of operating positions, and motor means for pivoting said rocker bar from the retracted position to an operating position in the range of operating positions.

38. A grinding machine as set forth in claim 37 wherein said means for effecting relative movement between said master cam and cam follower means independently of movement of said carriage includes a cam follower motor which is disposed on said carriage and means connecting said cam follower motor with said cam follower means to effect movement of said cam follower means relative to said master cam means upon operation of said cam follower motor.

39. A grinding machine as set forth in claim 37 wherein said control means further includes biasing means connected with said rocker bar for urging said rocker bar away from the retracted position with a first force during one portion of the grinding of a lobe on the camshaft and for urging said rocker bar away from the retracted position with a second force which is less than the first force during another portion of the grinding of a lobe on the camshaft.

40. A method of operating a grinding machine having a rocker bar which supports a camshaft having a plurality of cam lobes for movement toward and away from a grinding wheel by the interaction between a master cam assembly containing a plurality of master cam elements and a cam follower which is engageable with each of the master cam elements in turn, said method comprising the steps of supporting the camshaft on the rocker bar, pivoting the rocker bar toward the grinding wheel from a retracted position through an index position to an operating position in a range of operating positions, effecting relative movement between the plurality of master cam elements and the cam follower to engage a first one of the master cam elements with the cam follower as the rocker bar reaches an operating position in the range of operating positions, pivoting the rocker bar through a plurality of operating positions in the range of operating positions under the influence of the first cam element and the cam follower during grinding of a first cam lobe on the camshaft, pivoting the rocker bar from the range of operating positions to the index position, separating the cam follower and master cam assembly by a first distance as the rocker bar pivots from the range of operating positions to the index position, effecting relative movement between the cam follower and master cam assembly to align the cam follower with a second one of the master cam elements while the rocker bar is in the index position and while the cam follower and master cam assembly are separated by the first distance, pivoting the rocker bar toward the grinding wheel from the index position back to an operating position in the range of operating positions, effecting relative movement between the master cam assembly and cam follower to engage the second one of the master cam elements with the cam follower upon movement of the rocker bar back to an operating position in the range of operating positions, pivoting the rocker bar through a plurality of operating positions in the range of operating positions under the influence of the second cam element and the cam follower during grinding of a second cam lobe on the camshaft, thereafter pivoting the rocker bar from the range of operating positions through the index position and back to the retracted position, and separating the cam follower and master cam assembly by a second distance which is greater than the first distance as the rocker bar pivots from the range of operating positions back to the retracted position.

41. A method as set forth in claim 40 wherein the step of grinding the first cam lobe includes the step of removing material from the first cam lobe at a first rate during a rough grinding operation and subsequently removing material from the first cam lobe at a second rate which is less than the first rate during a finish grinding operation, said method further including the steps of urging the rocker bar away from the retracted position and toward the grinding wheel with a first force during the rough grinding operation, and urging the rocker bar away from the retracted position and toward the grinding wheel with a second force which is less than the first force during the finish grinding operation.

42. A method as set forth in claim 40 wherein said step of pivoting the rocker bar toward the grinding wheel from a retracted position through an index position to an operating position includes the step of pivoting the rocker bar away from the retracted position at a first speed and reducing the speed of pivotal movement of the rocker bar prior to movement of the rocker bar into the range of operating positions to reduce the speed of relative movement between the plurality of cam elements and cam follower prior to engagement of the cam follower with the first one of the cam elements.

43. A method of operating a grinding machine as set forth in claim 40 and wherein the rocker bar is disposed on a carriage which is movable relative to the grinding wheel and a base of the grinding machine, said method further including the step of moving the carriage relative to the grinding wheel and base after grinding the first cam lobe and prior to grinding the second cam lobe, said step of effecting relative movement between the cam follower and master cam assembly to align the cam follower with a second one of the master cam elements being performed independently of movement of the carriage relative to the base of the grinding machine.

44. A method of operating a grinding machine having a base upon which a movable carriage is disposed with a rocker bar on the carriage to support a camshaft having a plurality of lobes for movement toward and away from a grinding wheel by the interaction between a master cam assembly containing a plurality of master cam elements and a cam follower which is engageable with each of the master cam elements in turn, said method comprising the steps of supporting the camshaft on the rocker bar, pivoting the rocker bar relative to the carriage and toward the grinding wheel from a retracted position to an operating position in a range of operating positions, effecting relative movement between the master cam assembly and cam follower from a condition in which the cam follower and master cam assembly are spaced apart to a condition in which the cam follower is disposed in engagement with a first one of the master cam elements as the rocker bar reaches an operating position in the range of operating positions, pivoting the rocker bar through a plurality of operating positions in the range of operating positions under the influence of the first cam element and cam follower during grinding of a first cam lobe on the camshaft, pivoting the rocker bar from the range of operating positions toward the retracted position, separating the cam follower and master cam assembly as the rocker bar pivots from the range of operating positions toward the retracted position, moving the carriage relative to the base to align a second cam lobe on the camshaft with the grinding wheel, effecting relative movement between the cam follower and master cam assembly independently of movement of the carriage relative to the base to align the cam follower with a second one of the master cam elements while the cam follower and master cam assembly are separated by the movement of the rocker bar from the range of operating positions, pivoting the rocker bar toward the grinding wheel back to an operating position in the range of operating positions, effecting relative movement between the master cam assembly and cam follower to engage the second one of the master cam elements with the cam follower upon movement of the rocker bar back to an operating position in the range of operating positions, and pivoting the rocker bar through a plurality of operating positions in the range of operating positions under the influence of the second cam element and the cam follower during grinding of a second lobe on the camshaft.

45. A method as set forth in claim 44 wherein said step of effecting relative movement between the cam follower and master cam assembly independently of movement of the carriage includes the steps of operating a motor to move the cam follower relative to the master cam assembly and operating a signal generator to provide output signals, and utilizing the output signals from the signal generator to determine when the cam follower is in a desired position relative to said master cam assembly.

46. A method as set forth in claim 45 wherein the step of grinding the first cam lobe includes the step of removing material from the first cam lobe at a first rate during a rough grinding operation and subsequently removing material from the first cam lobe at a second rate which is less than the first rate during a finish grinding operation, said method further including the steps of urging the rocker bar away from the retracted position and toward the grinding wheel with a first force during the rough grinding operation, and urging the rocker bar away from the retracted position and toward the grinding wheel with a second force which is less than the first force during the finish grinding operation.

47. A method as set forth in claim 45 wherein said step of pivoting the rocker bar toward the grinding wheel from a retracted position to an operating position includes the step of pivoting the rocker bar away from the retracted position at a first speed and reducing the speed of pivotal movement of the rocker bar prior to movement of the rocker bar into the range of operating positions to reduce the speed of relative movement between the plurality of cam elements and cam follower prior to engagement of the cam follower with the first one of the cam elements.

48. A machine for rough grinding and finish grinding a camshaft comprising:

a base;

a work table movable along said base;

a rocking bar assembly pivotally supported from said work table for movement about a pivot axis;

a master cam assembly, having a plurality of master cams, supported on said rocking bar assembly for rotation about a workpiece axis, spaced apart from the pivot axis;

workpiece holding means for supporting the camshaft on said rocking bar assembly for unitary movement with said master cam assembly around the workpiece axis;

a driven grinding wheel movable into engagement with the camshaft for grinding the camshaft to a desired finish;

drive means for rotating said master cam and the unitarily movable camshaft;

a master cam follower indexible with respect to said master cam assembly;

rocking bar positioning means for moving said rocking bar and said master cam assembly to a position wherein said master cam follower engages one of said master cams and for moving said rocking bar and said master cam assembly to a position away from said master cam follower;

variable biasing means, operable when said rocking bar positioning means moves one of said master cams into engagement with said master cam follower, for biasing the master cam into engagement with said master cam follower with a first biasing force when rough grinding the camshaft and a second biasing force when finish grinding the camshaft;

master cam indexing means, operable independent of the movement of said work table, for moving said master cam follower into alignment with one of said master cams corresponding to the cam lobe on the camshaft to be ground; and, adjustable stop means, operable in conjunction with said rocking bar positioning means, for stopping rocker bar movement away from said follower at a first position, when loading or unloading the camshaft, and at a second intermediate position when indexing said master cam follower with respect to said master cam assembly.

49. A machine as claimed in claim 48 wherein said variable biasing means comprises:

a hydraulic actuator having a first portion fixed with respect to said work table and a second portion movable to a first position engaging said rocking bar assembly and forcing said rocking bar assembly into engagement with said adjustable stop means, a second position spaced apart from the rocking bar by a first distance, and a third position spaced apart from the rocking bar by a second greater distance; and, a plurality of springs connected between said rocking bar assembly and the movable portion of said hydraulic actuator.

50. A machine as claimed in claim 48 wherein said master cam indexing means comprises:

a gear rack;

connecting means for connecting said gear rack to said master cam follower for positioning said master cam follower as the gear rack moves while permitting free rotation of said master cam;

a drive gear for engaging and driving said gear rack;

a servo motor connected to position said drive gear;

an encoder connected by appropriate gearing to be moved by said drive gear for indicating the position of said master cam follower; and control means for driving said servo motor to index said master cam follower to a desired position when said stop means is in the intermediate stop position.

51. A grinding machine as claimed in claim 48 wherein said adjustable stop means comprises:

a fixed stop formed on said work table for engaging a first stopping member attached to said rocking bar for limiting rocking bar movement; and, a positionable stop movable on said work table to a position and for engaging a second stopping member attached to said rocking bar for limiting rocking bar movement.

52. A grinding machine as claimed in claim 51 wherein said first stopping member and said second stopping member are adjustable with respect to said rocking bar.

53. A machine for grinding cams formed on a camshaft comprising:

a base;

a grinding wheel;

a work table movable on said base;

a rocking bar assembly mounted on said work table for back and forth pivotal movement;

a workholder, mounted on said rocking bar, supporting the camshaft for rotary movement;

work table drive means for positioning the work table so a cam to be ground is aligned with said grinding wheel;

a master cam assembly, supporting a plurality of master cams which correspond to the cams on the camshaft, disposed on said rocking bar in endwise alignment with the camshaft for rotary movement therewith;

a follower which is indexible to be aligned with a master cam corresponding to the cam to be ground;

indexing means for indexing said follower;

rocking bar positioning means for biasing said rocking bar to a position wherein one of the master cams engages said cam follower for moving the rocking bar back and forth as a cam on said camshaft is ground and for biasing said rocking bar away from said follower when a cam is not being ground;

stop means for stopping said rocking bar when said rocking bar is biased away from said follower at a load position when the camshaft is loaded or unloaded and at an intermediate position when the follower is indexed.

54. A machine for grinding camshafts comprising:

a base;

a work table movable along said base;

a rocking bar assembly pivotally supported from said work table for movement about a pivot axis;

a master cam assembly, having a plurality of master cams, supported on said rocking bar assembly for rotary movement about an axis spaced apart from the pivot axis;

workholding means supporting a camshaft on said rocking bar assembly for rotary movement with said master cam assembly about the axis;

a driven grinding wheel movable to engage and grind the camshaft;

work driving means for rotating said master cam and the camshaft;

a master cam follower movable to be aligned with a selected master cam;

rocking bar positioning means for moving said rocking bar toward said master cam so a master cam engages said master cam follower and for moving said rocking bar away from said master cam follower;

a ball screw assembly connected to said work table for positioning said work table;

a servo motor connected to said ball screw assembly for positioning the work table at a desired position with respect to said grinding wheel;

master cam follower positioning means for moving said master cam follower to desired positions;

a servo motor driving said follower positioning means for positioning said follower to be engaged by a master cam corresponding to the cam lobe to be ground; and control means controlling said worktable servo drive and said cam follower servo drive for positioning the camshaft with respect to the grinding wheel and the master cam follower with respect to the master cam assembly.

* * * * *